US008402746B2

(12) United States Patent
Powell et al.

(10) Patent No.: US 8,402,746 B2
(45) Date of Patent: Mar. 26, 2013

(54) EXHAUST GAS CAPTURE SYSTEM FOR OCEAN GOING VESSELS

(76) Inventors: John Powell, Santa Clarita, CA (US); Robert Sharp, Camarillo, CA (US)

( * ) Notice: Subject to any disclaimer, the term of this patent is extended or adjusted under 35 U.S.C. 154(b) by 288 days.

(21) Appl. No.: 12/772,520

(22) Filed: May 3, 2010

(65) Prior Publication Data

US 2011/0265449 A1 Nov. 3, 2011

(51) Int. Cl.
*F01N 3/00* (2006.01)
*F23J 15/00* (2006.01)

(52) U.S. Cl. ..... 60/281; 60/282; 60/283; 60/284; 60/285; 440/88 R; 440/89 R; 141/279; 141/387; 141/388

(58) Field of Classification Search ..... 440/88 R, 440/89 R; 141/279, 387, 388; 60/281, 282, 60/283, 284, 285
See application file for complete search history.

(56) References Cited

U.S. PATENT DOCUMENTS

| | | | | |
|---|---|---|---|---|
| 1,013,358 | A | 1/1912 | Andrews | |
| 1,439,226 | A | 12/1922 | Clarke | |
| 4,099,452 | A | 7/1978 | Costen | |
| 4,442,766 | A | 4/1984 | Hawkins | |
| 4,637,300 | A | 1/1987 | Cole | |
| 4,756,359 | A | 7/1988 | Greer | |
| 4,912,928 | A | 4/1990 | Kaneko | |
| 5,092,226 | A | 3/1992 | McCloskey | |
| 5,281,246 | A | 1/1994 | Ray et al. | |
| 5,460,301 | A | 10/1995 | Ebinger et al. | |
| 5,603,215 | A | 2/1997 | Sung et al. | |
| 5,613,990 | A | 3/1997 | Diachuk | |
| 5,622,538 | A | 4/1997 | Diachuk | |
| 5,687,773 | A | 11/1997 | Ryan et al. | |
| 5,823,218 | A | 10/1998 | Schlecht et al. | |
| 5,827,490 | A | 10/1998 | Jones | |
| 5,842,918 | A | 12/1998 | Cowen | |
| 5,980,343 | A | 11/1999 | Rollinski | |
| 6,022,389 | A | 2/2000 | Vross et al. | |
| 6,176,082 | B1 | 1/2001 | Shaffer | |
| 6,244,918 | B1 | 6/2001 | Cameron | |
| 6,332,308 | B1 | 12/2001 | Miller | |
| 6,442,933 | B2 | 9/2002 | Rusch | |
| 6,463,958 | B1 | 10/2002 | Schwing | |
| 6,647,711 | B1 | 11/2003 | Spiegel et al. | |
| 6,660,239 | B2 | 12/2003 | Nagji | |
| 6,667,011 | B1 | 12/2003 | Munje et al. | |
| 6,726,736 | B2 | 4/2004 | Koclejda et al. | |
| 6,761,868 | B2 | 7/2004 | Brooks et al. | |
| 6,910,930 | B1 | 6/2005 | Mitchell | |
| 7,258,710 | B2 * | 8/2007 | Caro et al. | 55/385.1 |
| 7,275,366 | B2 | 10/2007 | Powell et al. | |
| 2004/0144080 | A1 | 7/2004 | Suzuki et al. | |
| 2004/0163377 | A1 | 8/2004 | Liu | |
| 2007/0209544 | A1 * | 9/2007 | Caro et al. | 105/26.05 |

* cited by examiner

*Primary Examiner* — Thomas Denion
*Assistant Examiner* — Brandon Lee
(74) *Attorney, Agent, or Firm* — Kenneth L. Green

(57) ABSTRACT

An exhaust gas capture system for capturing the exhaust gas emitted by auxiliary engines, auxiliary boilers, and other sources on an Ocean Going Vessel (OGV) while at berth or at anchor so that these gases may be carried to an emissions treatment system for removal of air pollutants and or greenhouse gases. The exhaust gas capture system includes a manifold and a family of parallel-flow flexible ducts for connecting directly to individual OGV exhaust pipes. The exhaust gas capture system further includes apparatus for connecting the parallel-flow flexible ducts to the OGV exhaust pipes.

19 Claims, 14 Drawing Sheets

EXHAUST GAS CAPTURE SYSTEM FOR OCEAN GOING VESSELS

BACKGROUND OF THE INVENTION

The present invention relates to control of emissions from Ocean Going Vessels (OGVs) at berth or anchored in port and in particular to the capture of exhaust gases from the OGVs to allow subsequent processing.

OGVs at berth or anchored in port are a significant source of air pollution from the exhaust gases of their auxiliary power sources. The OGVs have auxiliary diesel engines and auxiliary boilers which normally remain in operation while the OGV is at berth or anchored. The auxiliary engines drive generators which provide power for ballast and other pumps, onboard motors, shipboard lighting and air conditioning, communications equipment, and other housekeeping functions. The auxiliary boilers are used to keep the bunker fuel used to feed the main engines warm. If allowed to cool, this fuel becomes so viscous it is difficult or impossible to pump. Heat from the boilers is also used for other shipboard functions.

The boilers and auxiliary engines are a source of nitrogen dioxide (NOx), sulfur dioxide (SOx), particulate matter (PM), and volatile organic compounds (VOCs), all of which are air pollutants. Left untreated, the OGVs are one of the most significant sources of air pollution in the vicinity of ports throughout the world.

The OGV discharge the exhaust from the auxiliary engines and auxiliary boilers, as well as other less significant pollutant sources such as the galley and incinerators, through exhaust pipes clustered within an exhaust stack which runs from the engine room up through the OGV's decks and continues some distance above the top deck. U.S. Pat. No. 7,258,710 for "Maritime Emissions Control System," assigned to the assignee of the present invention, describes a maritime emissions control system which may be transported by barge or vessel to an OGV near or within a harbor. The maritime emissions control system uses a bonnet (or umbrella-like device) which is lifted up above the top of the OGV exhaust stack and then lowered over the entire exhaust stack of the OGV and sealing around the exhaust stack perimeter, thereby capturing exhaust otherwise released to the environment. The '710 patent further discloses processing the exhaust flow from the OGV to reduce emissions. The '710 patent is herein incorporated in its entirety by reference.

The top of the stack is usually the highest part (other than antennas) of the OGV. The stack of an OGV is typically 15 to 30 feet on a side and often rectangular, but it can be round or oval or some other shape. The stack side walls are usually vertical or slightly tapered, but sometimes have sharp lips protruding from the side, railings near the top, or other features which depart from smooth sides, and the stacks frequently include air intakes for the engine room and other interior spaces at some point below the stack rim. The individual exhaust pipes exit through a recessed floor located a few feet below the top rim of the stack, and generally extend upward a small distance above the stack.

Unfortunately, there are some difficulties in positioning a bonnet over the OGV stack. The OGV's antennas are often close to the stack, wires are often attached to the rim of stack, the stack may be built into OGV superstructure, appendages reach from the rim of stack, and/or extreme stack dimensions.

Another issue is the difficulty in sealing the bonnet to the stack, which can result in escape of exhaust gas or ingestion of air through a gap between the vessel stack and the inner periphery of the bonnet in which case the bonnet will capture only a portion of the exhaust gas and simultaneously ingest significant volumes of atmospheric air reducing the efficiency of the processing unit. Tension devices intended to effect a seal between the bonnet and stack are difficult at best to implement on a rectangular surface with large flat sides, and bladder type devices are cumbersome and unreliable and require external apparatus such as an air blower or pressure vessel to inflate them. Even if an acceptable seal is achieved with a bonnet, wind forces and wind gusts "pump" the bonnet like a bellows once it is attached, and this action may force exhaust gas out around the perimeter while simultaneously creating over-pressure followed by under-pressure within the bonnet and consequently on the boiler exhaust, which is detrimental to boiler performance and can even cause flame extinguishment in extreme cases.

Another issue is the ingestion of non-exhaust gas flowing from vent pipes in the stack, gaps around each of the exhaust pipes where they exit the stack deck, gaps around the access door to the stack deck, and steam vents. Another issue is the bonnet's size and weight make using it on a barge potentially difficult.

Another issue is the "breathing" or volumetric changes to the inside volume of the bonnet caused by wind eddies and gusts, which often have the effect of forcing exhaust gas out the imperfect seal around the interface between the bonnet and the stack.

Another issue is the difficulty in attaching the bonnet to the stack during high winds because of the large bonnet surface area exposed to the wind. The surface of a bonnet sufficiently large to encompass the typical OGV exhaust stack is 20 to 30 feet on a side, usually square, rectangular, hexagonal, octagonal, or oval. Such a large surface, hanging from a crane or other placement device many tens of feet and often over 100 feet in the air, is frequently subjected to wind forces which cause the bonnet to sway with relatively large excursions, creating the danger of hitting and damaging antennas or other nearby OGV structures. This movement also makes alignment and attachment to the stack difficult if not impossible in windy conditions.

An additional drawback to the bonnet is its weight. Due to the size required to encompass the OGV stack, the bonnet and its actuating and support structure is heavy, requiring a substantial lifting capability for the crane or other placement device.

Yet another drawback is inherent in the large volume enclosed by the bonnet. The interior of the bonnet is the size of a room, so control of the vacuum within this bonnet which is necessary to ensure that gas is drawn out of the pipes rather than impeded from exiting each exhaust pipe, and of ensuring that over pressure will not force exhaust gas back down to the engine room through openings in the stack itself, is very difficult, exacerbated by variable exhaust flows and gusting wind.

Another issue is that known bonnet designs are fairly complex and may prove unreliable. Known bonnet designs include numerous motors, cables, and control devices to furl and unfurl or extend and retract and secure the bonnet to the stack, all of which add complexity, weight, and failure modes, and require that electrical, pneumatic, or hydraulic power be routed to the bonnet. Additionally, a large crane or similar lifting and placement device is required for the bonnet due to its weight and potential wind forces, which adds cost and structure needed to support the crane.

BRIEF SUMMARY OF THE INVENTION

The present invention addresses the above and other needs by providing an exhaust gas capture system for capturing the exhaust gas emitted by auxiliary engines, auxiliary boilers, and other sources on an Ocean Going Vessel (OGV) while at berth or at anchor so that these gases may be carried to an emissions treatment system for removal of air pollutants and/or greenhouse gases. The exhaust gas capture system includes a manifold and a family of parallel-flow ducts for connecting directly to each individual OGV exhaust pipe and carrying parallel exhaust gas flows to the common manifold. The exhaust gas capture system further includes apparatus for connecting the parallel-flow flexible ducts to the OGV exhaust pipes.

In accordance with another aspect of the invention, there is provided a system for capture and removal of the pollutant-laden exhaust gas from the OGV exhaust pipes. Once captured, the exhaust gases are carried to an emissions treatment system on shore, or on a barge, for pollutant removal.

In accordance with yet another aspect of the invention, there are provided couplings to connect each of the parallel exhaust gas collecting ducts to individual OGV exhaust pipes. The couplings serve several functions and may take on any of several forms, employ any of several means of securing each coupling to the pipes, and use any of several means for closing off or sealing the interface between the duct and the exhaust pipe to reduce or eliminate exhaust gas leakage. In accordance with another aspect of the invention, a placement device lifts the manifold and ducts to a position directly above the exhaust pipes so that the parallel ducts may be deployed over the individual OGV exhaust pipes without further manual or mechanical intervention required to extend the ducts to reach the exhaust pipes.

In accordance with another aspect of the invention, a robotic manipulator arm is preferably used to position the parallel ducts for coupling to the exhaust pipes. Alternatively, alignment may be conducted by a technician who has been lifted up above the top of the stack near the exhaust pipe exit by a manlift or other conveyance or by a technician aboard the OGV, and connection of the parallel ducts to the individual exhaust pipes effected either manually or by other means such as a remote controlled actuating device.

In accordance with another aspect of the invention, there is provided a manifold positionable near the top of the OGV exhaust stack. The manifold serves multiple functions, among them: a collection manifold to accept exhaust gas from the parallel-flow flexible ducts and discharge the combined exhaust gas through one common duct to an emissions treatment system; a pressure/vacuum control chamber; an overpressure and under-vacuum safety relief device; a pneumatic compliance to moderate the effects of transitions in flow rate as engines or boilers come on or off line; and a docking station for the parallel-flow flexible ducts.

In accordance with still another aspect of the invention, there are provided parallel-flow flexible ducts, each of which connect the manifold to an OGV exhaust pipe. The parallel-flow flexible ducts may hang in a loop, be housed in a magazine attached to the manifold, or be on a roll. When not in use, a free end of each parallel flexible duct is secured to a docking station on the manifold. A manually operated or robotic manipulator arm is used to undock the parallel-flow flexible ducts one at a time and position the parallel-flow flexible ducts for coupling to the OGV exhaust pipes. Alternatively, this undocking and moving function may be performed manually. Further, the parallel flexible ducts may simply either hang freely, or be released from the docking station and allowed to drop to a location above the OGV exhaust pipes. Various available motions (degrees of freedom) of the manipulator arm may be employed to perform additional functions both during the act of removing each of the parallel-flow flexible ducts from its docking station, and during actions of positioning and coupling each flexible duct to a corresponding exhaust pipe.

In accordance with yet another aspect of the invention, there are provided automatically actuated valves, couplings and seals for each of the parallel-flow flexible ducts. The action of lifting or undocking each of the parallel-flow flexible ducts may be coupled to a mechanism on the manipulator arm to open or close valves and/or clamps or latches of the parallel-flow flexible ducts. For example, the simultaneous act of gripping (squeezing) a duct lifting handle may perform these or other actions. Similarly, while placing the coupling over the exhaust pipe, the actions of lifting or releasing, as well as the ability of the end effector (the last robotic arm section, which is attached to the last joint on the manipulator arm) to rotate, may be coupled to placement, securing, and/or sealing of the attachment device.

In another aspect of the invention, each coupling device may be utilized to perform several functions, including alignment of each flexible duct with the corresponding exhaust pipe, facilitate flexible duct attachment to, or insertion over or inside the exhaust pipe, and seal or close off the interface between each flexible duct with the corresponding exhaust pipe.

In accordance with another aspect of the invention, there is provided a manipulator arm. The manipulator arm may be a commercially available device which may be modified for use with the exhaust capture system, and it may be robotic or manually operated by a joystick, opening and closing valves, or other control devices. Operation of the manipulator arm may be integrated into a control system which positions the manifold near the OGV stack. Alternatively or additionally, sensors and/or a vision system may be included to locate the individual exhaust pipes to direct the placement of the coupling devices on or over each exhaust pipe. When the manipulator arm is coupled with a vision system, a remote operator is able to place the manifold into the required location and then attach the individual flexible ducts to the exhaust pipes. Alternatively or additionally, infrared and/or acoustic and/or other sensors allowing partial or complete automatic operation, may be included in the exhaust gas capture system.

In accordance with yet another aspect of the invention, there is provided an OGV exhaust gas capture system having advantages over a bonnet including simplicity of design and mechanisms, reliability, small size, low weight, minimal power requirements, the possibility of relatively unskilled or even unattended operation, and low operational and maintenance cost.

In accordance with another aspect of the invention, there is provided an OGV exhaust gas capture system having a connector including a coupling and a stepped cone. The coupling selected from an elastomeric rigid cone with the diameter becoming larger away from the open end which is pushed into the OGV exhaust pipe, and which further includes ribs on the outside of the cone to increase the holding power of the cone inside the OGV exhaust pipe, and an elastomeric coated rigid cone with the diameter becoming larger away from the open end which is pushed into the OGV exhaust pipe, and which further includes ribs on the outside of the cone to increase the holding power of the cone inside the OGV exhaust pipe. The stepwise tapered elastomeric cone includes exterior ridges which will fit into various sizes of OGV exhaust pipe inside diameters.

In accordance with yet another aspect of the invention, there is provided an OGV exhaust gas capture system having a connector including a drape-like assembly which is draped over the outside of the OGV exhaust pipe and which then falls or scoots down the outside of the pipe, pulling the flexible duct into place over the open end of the exhaust pipe. The drape-like assembly includes segmented vertically spaced apart horizontal stringers and attached at either end to a vertical cable. The vertical cables are spread apart by the horizontal stringers and horizontal bars at the bottom of the drape-like assembly, the horizontal bars carrying several spaced apart rollers. A flat plate at the top of the drape-like assembly mates to the flexible duct and has an opening approximately the size of the exhaust pipe bore and an elastomeric gasket to seal against the end of the pipe, and three or more tapered ribs or a tapered cage which centers the flat plate over the opening of the exhaust pipe.

In accordance with yet another aspect of the invention, there is provided an OGV exhaust gas capture system having a manifold serving as a pressure/vacuum control chamber, wherein the volume of the manifold provides mechanical compliance to smooth out pressure excursions which could otherwise occur when flows from the OGV exhaust pipes change. The manifold includes a plenum, pressure sensors, a double acting valve, lightweight manifold couplings, a docking station, and valves. The pressure sensors provide a feedback control signal for a fan, adjusting the fan speed to maintain a slight vacuum within the manifold regardless of exhaust flow. The double acting valve in one end of the manifold providing an over-pressure relief and an under-pressure relief to protect the system and especially the ship systems. The lightweight manifold couplings couple the plurality of flexible ducts connecting the OGV exhaust pipes to the manifold. The docking station may include a hook, bracket, or other mechanical means of hanging the flexible duct; or a magazine or cylindrical chamber into which the flexible duct is collapsed for storage. The valves are provided to adjust and balance the flow from the OGV exhaust pipes.

In accordance with yet another aspect of the invention, there is provided an OGV exhaust gas capture system having a manifold having a hook, a bracket, or other mechanical means of hanging unused flexible ducts, (i.e., flexible ducts not connected to OGV exhaust pipes. Valves are provided to close off the unused flexible ducts to avoid ingesting outside air and thereby increasing the load on an induced draft fan which would require more electricity.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

In the following detailed description, the term stack refers to the large structure protruding from the upper part of an Ocean Going Vessel (OGV) and from which exhaust gas may be observed to exit. An alternative term for stack, used by some in the marine field, is funnel. The stack contains or encompasses several individual OGV exhaust pipes. Each of the OGV exhaust pipes connects to one source of exhaust gas such as one auxiliary engine or one auxiliary boiler or the onboard incinerator. The terms vessel and OGV mean one and the same, namely an ocean going vessel used to transport cargo or people, and the terms are used interchangeably. The term hotelling means the OGV is at berth or at anchor with the main engines off. During hotelling, ongoing shipboard activities continue to require electrical, heat, and steam power.

Figure 1:
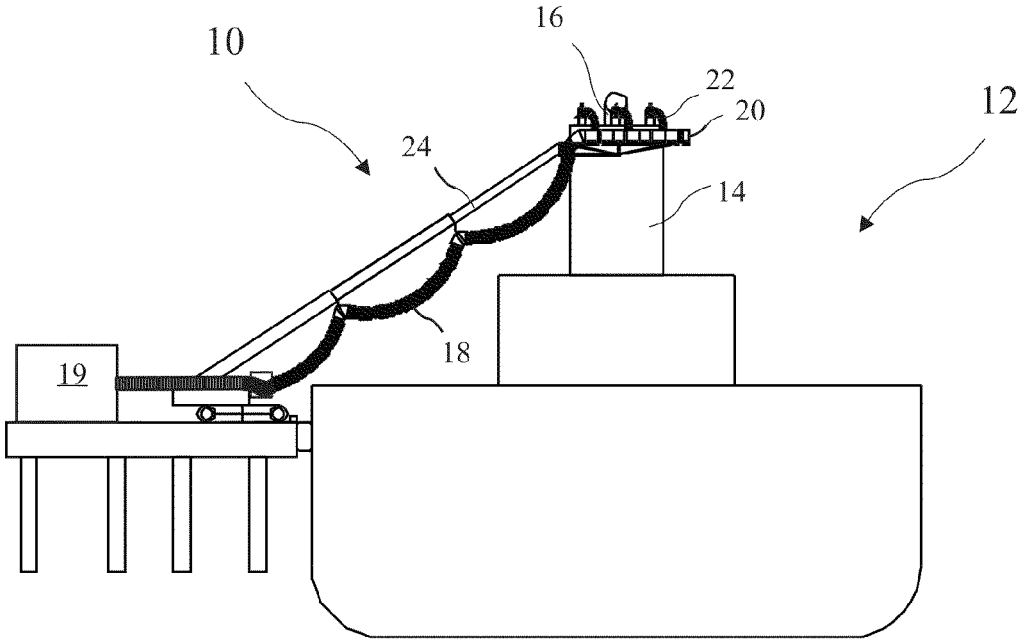
FIG. 1 shows an exhaust capture system according to the present invention attached to an Ocean Going Vessel (OGV).

An exhaust capture system 10 according to the present invention is shown in FIG. 1 attached to an Ocean Going Vessel (OGV) 12. The exhaust capture system 10 captures Ocean Going Vessel (OGV) exhaust gases otherwise released to the atmosphere from OGV exhaust pipes 16 having generally horizontally facing mouths 16*a* (see FIGS. 3A, 3B, and 4) inside the OGV stack 14 during hotelling. The captured exhaust gases are carried through a family of parallel-flow flexible ducts 22 to a manifold 20, and from the manifold 20 through a main duct (or hose) 18 to an emissions treatment system 19 where air pollutants and or greenhouse gasses can be removed. The parallel-flow flexible ducts 22, manifold 20, and main duct 18 are positioned and supported by a duct support boom 24. The parallel-flow flexible ducts 22 do not necessarily reside side by side and parallel, but when more than one of the parallel-flow flexible ducts 22 are connected to corresponding OGV exhaust pipes 16, the parallel-flow flexible ducts 22 provide parallel paths for exhaust gases from the OGV exhaust pipes 16 to the manifold 20. The OGV exhaust pipes 16 preferably do not require modification for attachment of the parallel-flow flexible ducts 22.

Commercial OGVs 12 such as container vessels, tankers, passenger, RoRo, and bulk carriers have several OGV exhaust pipes 16. Each of the OGV exhaust pipes 16 receives exhaust gas from one or more source of exhaust gas such as an auxiliary diesel engine, auxiliary boiler, or incinerator. The OGV 12 typically has three or more auxiliary engines of which one or two are operating while the OGV 12 is at berth, and one or more auxiliary boilers of which one is normally operating either continuously or intermittently at berth, except in the case of tankers offloading cargo with onboard steam driven pumps, in which case two or three auxiliary boilers may be operating. There are also minor sources of gaseous discharge from OGV 12 housekeeping activities such as the galley or incinerator, each of which has an exhaust pipe, but these are generally not a significant source of air pollution and the incinerator is not usually used in port. The only exhaust pipes to which this invention would normally be connected are those from the auxiliary boiler(s) and the auxiliary engines.

The OGV 12 main engine exhaust pipe(s) are not addressed by the present invention because the main engines are not operating during the time the OGV 12 is at berth or at anchor except during preparation for departure (main engines are almost always direct coupled, so if the main engine is running the propeller is turning.) The OGV exhaust pipes 16 addressed by the exhaust capture system 10, of which there are typically five or more from auxiliary engines, auxiliary boilers, and other sources, are generally routed through the OGV stack 14 and exit the OGV 12 through passages in a floor within the stack 14, which floor is usually located a few feet below the top of the stack 14. The pipes 16 extend vertically above the floor and above the peak of the exhaust stack 14.

The top end of the OGV exhaust pipes 16 may be vertical, bent toward horizontal, or cut at an angle, and occasionally the OGV exhaust pipes 16 are simply vertical pipes open at the top. However, the tops of the individual OGV exhaust pipes 16 often include a 90 degree bend towards the OGV aft to direct the exhaust gas toward the aft end of the OGV 12. The OGV exhaust pipes 16 are round and the OGV exhaust pipes 16 diameter can vary from about 6 inches for an incinerator to 16 inches or more for a large auxiliary boiler. The OGV exhaust pipes 16 releasing the most pollution generally range from about eight inches to sixteen inches in diameter because incinerator exhaust is not normally an issue and is not an exhaust pipe size to which this invention would generally be required to address.

Figure 2B:
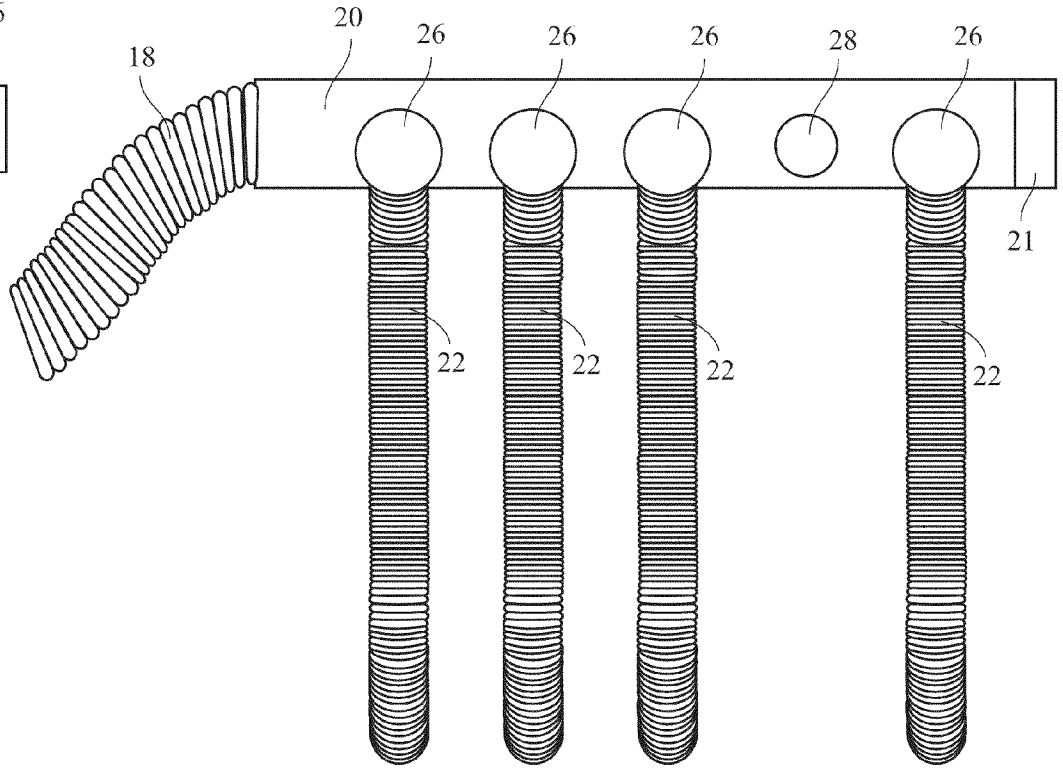
FIG. 2B is a front view of the manifold and multiple parallel-flow flexible ducts of the exhaust capture system according to the present invention for connecting to the OGV exhaust pipes.
Figure 2A:
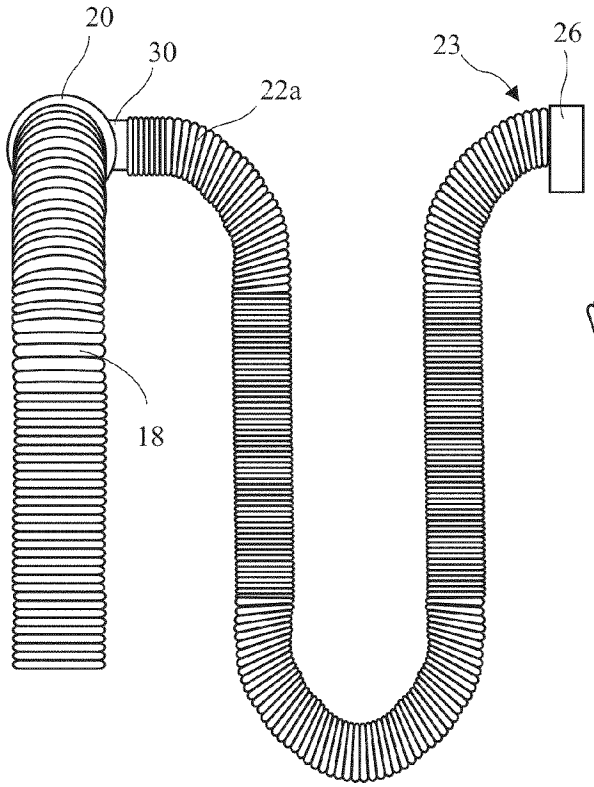
FIG. 2A is an end view of a manifold and multiple parallel-flow flexible ducts of the exhaust capture system according to the present invention for connecting to the OGV exhaust pipes.

A side view of the manifold 20, the main duct 18 and the parallel-flow flexible ducts 22 is shown in FIG. 2A and a front view of the manifold 20 and main duct 18 and parallel-flow flexible ducts 22 is shown in FIG. 2B. Each of the parallel-flow flexible ducts 22 is connected to the manifold 20 at fixed ends 22*a* through a manifold coupling 30. An exhaust pipe coupling 26 resides on a free end 23 (opposite the manifold 20) of each of the parallel-flow flexible ducts 22 respectively. A cap 28 resides over an unused manifold coupling 30 and a relief damper 21 resides at the end of the manifold 20 opposite the main duct 18. The main duct 18 connects the manifold 20 to the emissions treatment system 19.

Making a connection between the parallel-flow flexible ducts 22 and the OGV exhaust pipes 16 in order to route the exhaust gas to the emissions treatment system 19 requires addressing several factors. Any connection must accommodate six degrees of freedom motion of the OGV 12. The motions of the OGV 12 include translating in three directions and rotating about three axes. Additionally, the slow draft changes due to tide and cargo loading or unloading can lift or lower the OGV 12 as much as 40 feet vertically.

Another consideration is that the main ducting 18 required to carry the exhaust gas to the emissions treatment system 19 is generally too heavy and awkward to be easily handled manually, so some sort of assist is usually required. In addition it is possible, but not desirable, to require that personnel board the vessel and climb up the OGV stack 14 to connect the exhaust capture system 10 to the OGV exhaust pipes 16. The exhaust gas is hot, typically 550 degrees Fahrenheit, so any exhaust collection device must be capable of operating in a high temperature environment. Safety issues are a major concern and if an emergency is declared, all connections to the OGV must be freed within 20 to 30 minutes. All of this is complicated, because currently, modification of the OGV is not allowed.

The exhaust capture system 10 also includes the apparatus for positioning the manifold 20 in the vicinity of the top of the OGV exhaust stack 14, in which the exhaust from all the OGV exhaust pipes 16 is combined for transmission through a main duct 18 to the emissions treatment system 19. The exhaust capture system 10 also includes apparatus to set and maintain flow and pressure in each individual flexible duct as it is attached to an OGV exhaust pipe as well as during subsequent operation so as to preclude significant alteration of preexisting exhaust flows, back pressure, or boiler operation.

The exhaust capture system 10 may include sensors for determining the location of the OGV exhaust pipes 16 and moving the parallel-flow flexible ducts 22 to that location, aligning the parallel-flow flexible ducts 22 to the respective OGV exhaust pipe 16, securing an adequate seal, and providing an attachment to the exhaust pipe 16 sufficient to hold the parallel-flow flexible duct 22 in position. The locating, positioning, and attaching activity may be by direct visual means and a joy stick, by a valve block, or other manual controller, by video and or infrared and or acoustic and or laser or similar means with a remote human operator, or it may be partially or fully automatic with remote human oversight and override capability, or by a combination of these methods.

Figure 3B:
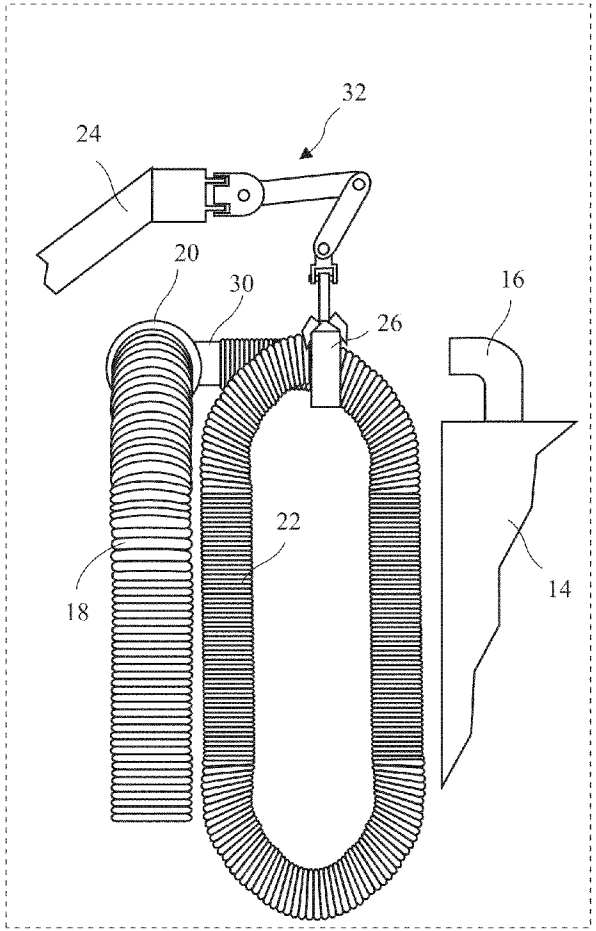
FIG. 3A-3D depict the method according to the present invention of a manipulator arm picking one of the multiple parallel-flow flexible ducts from its hangar and moving it into position over or in one of the OGV exhaust pipes.
Figure 3A:
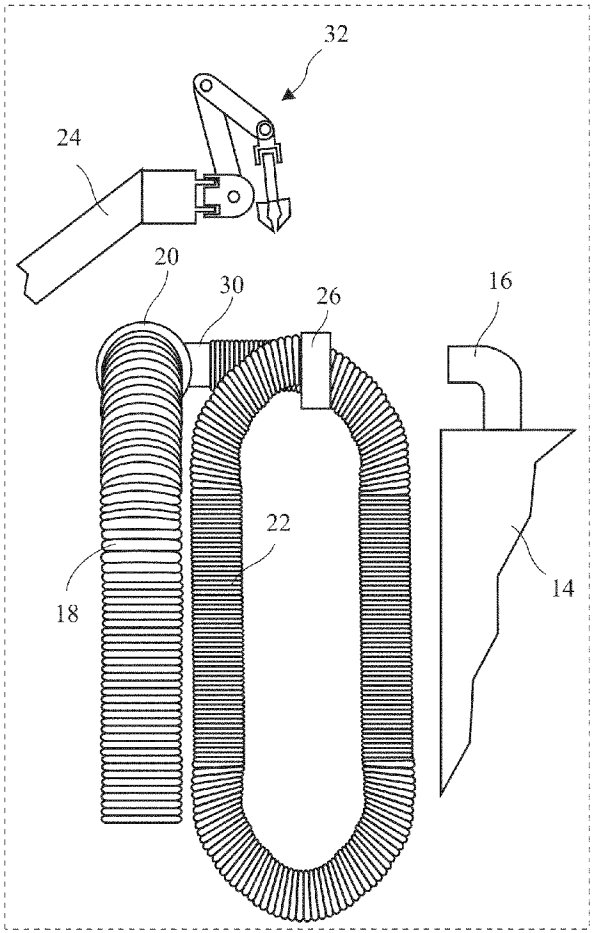
Figure 3D:
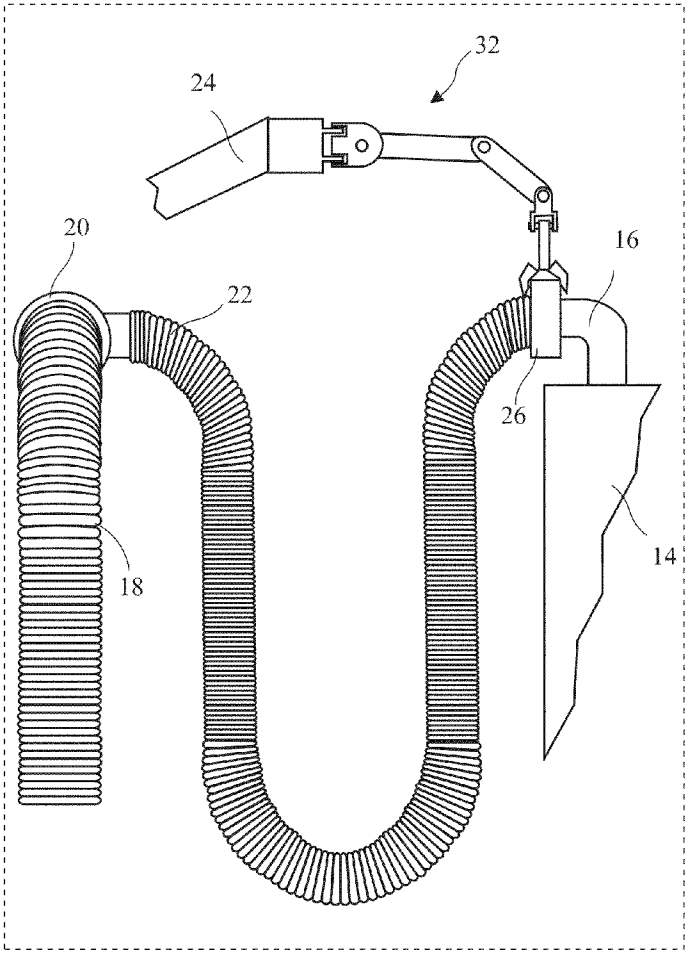
Figure 3C:
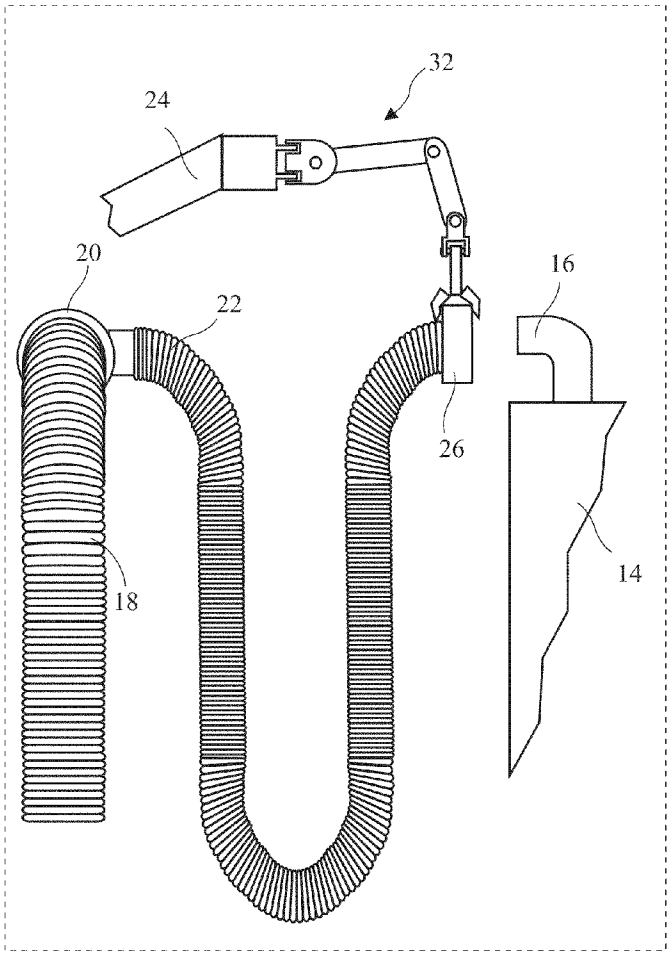

A method according to the present invention for attaching the parallel-flow flexible ducts 22 of the exhaust capture system 10 to individual OGV exhaust pipes 16 of the OGV 12 are shown in FIGS. 3A-3D. In FIG. 3A the duct support boom 24 which carries the manipulator 32 and also positions the manifold 20 (the connection of the boom 24 to the manifold 20 is not shown in FIG. 3A) and parallel-flow flexible ducts 22 are directed in a direction directly aft of the OGV exhaust pipes 16. In FIG. 3B a manipulating arm 32 grasps one of the individual flexible ducts 22. In FIG. 3C the manipulating arm 32 moves the grasped flexible duct 22 horizontally towards a corresponding exhaust pipe 16 for horizontal engagement of the flexible duct 22 with the OGV exhaust pipes 16. In FIG. 3D the manipulating arm 32 positions the coupling 26 over the corresponding exhaust pipe 16. The robotic apparatus for positioning and connecting the OGV exhaust gas capture system is preferably operated without participation by any OGV crew members and is positionable for operation without interference with either of OGV loading and offloading operations.

The flexible ducts 22 are sequentially attached to the OGV exhaust pipes 16 to collect the exhaust gas from the individual OGV exhaust pipes 16. The parallel-flow flexible ducts 22 capture and transport the OGV exhaust gas to the manifold 20 and the exhaust gas is subsequently carried by the main duct 18 to the emissions treatment system 19. The manifold 20 is preferably attached to a placement device such as a hydraulic lift (but may be attached to the duct support boom 24) which is capable of reaching a location proximal to the uppermost termination of the OGV exhaust stack 14. The manifold 20 includes instrumentation and mechanisms which may be used to control flow and/or pressure in various parts of the exhaust capture system 10.

The parallel-flow flexible ducts 22, and the coupling 26 which connects and seals the parallel-flow flexible ducts 22 to the OGV exhaust pipes 16, present a very small profile to the wind. The parallel-flow flexible ducts 22 and the coupling 26 are preferably approximately one foot in diameter as opposed to the 20 feet or more for a bonnet as described in the '710 patent. Since wind force is proportional to area, the force imparted to the parallel-flow flexible ducts 22 and the coupling 26 is 100 to 1000 times less than with a bonnet. The wind force is effectively even smaller, because the drag coefficient of a cylinder is on the order of 1.2 while for a flat surface it is approximately 2. The net result is that the exhaust capture system 10 of the present invention suffers very little force and resulting motion due to wind so is far easier to position over the OGV exhaust pipes 16, and it presents virtually no hazard to nearby antennas or other OGV structures.

Unlike a system using a bonnet, the exhaust capture system 10 has very small internal volume, acting as only a continuation of the OGV exhaust pipe 16 through the parallel-flow flexible duct 22 to the manifold 20. Thus, back pressures may be accurately controlled and maintained, and there is no bellows-like volumetric pumping as created by wind acting on a bonnet. Leaks are most likely to occur where the duct 22 or bonnet connects to the OGV exhaust pipes 16 or the stack 14 respectively. The amount of exhaust gas which will escape to the atmosphere from a leaking duct connection is extremely small by comparison to leaks in a bonnet connection because the duct connections have a circumference of approximately three feet, which is far shorter than the bonnet connection around the exhaust stack 14, which is 50 feet to 100 feet. It is also much easier to seal to a small round duct than a much larger bonnet.

Further, a bonnet may ingest substantial air through this same interface in addition to exhaust gas leaks around the periphery because the stack itself is not airtight, with numerous openings and gaps which communicate to below-deck spaces. Additionally, the negative pressure inside a bonnet will pull air from the pressurized engine room or other OGV compartments, creating dilution of the exhaust gas and requiring additional fan power to move the greater gas volume, which wastes energy and increases operating costs. The dilution air ingestion with a bonnet also reduces pollutant concentration, making pollutant removal more difficult. The shortcomings of a bonnet are thus eliminated with the exhaust capture system 10 direct connection to the OGV exhaust pipes.

Figure 4:
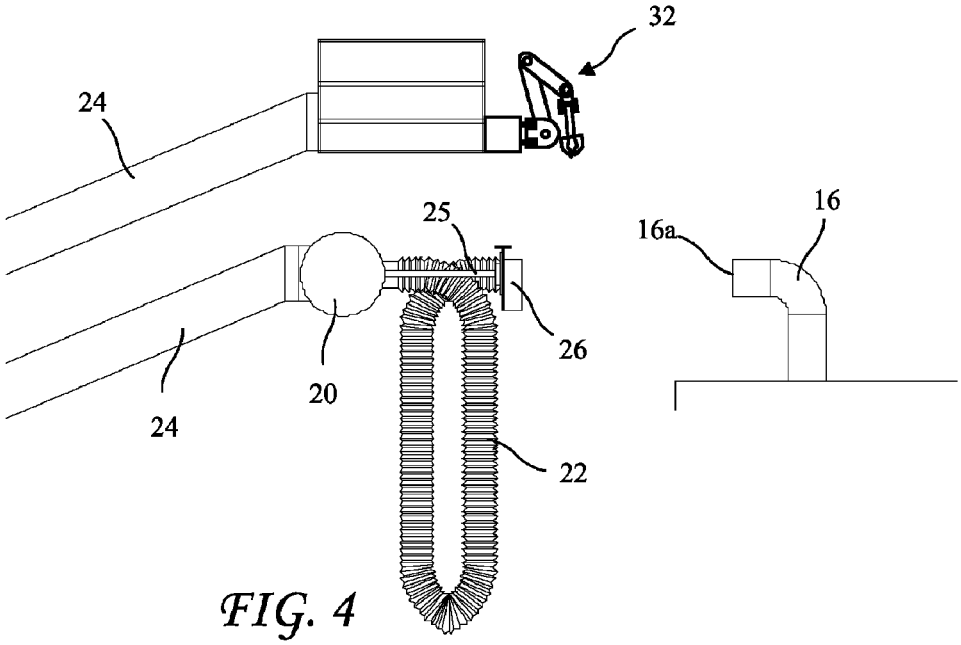
FIG. 4 shows a side view of a manipulator arm and the manifold positioned near the OGV exhaust pipes and the flexible ducts hanging from the manifold in a loop positioned for picking up by the manipulator arm and attaching to the OGV exhaust pipes according to the present invention.
Figure 5:
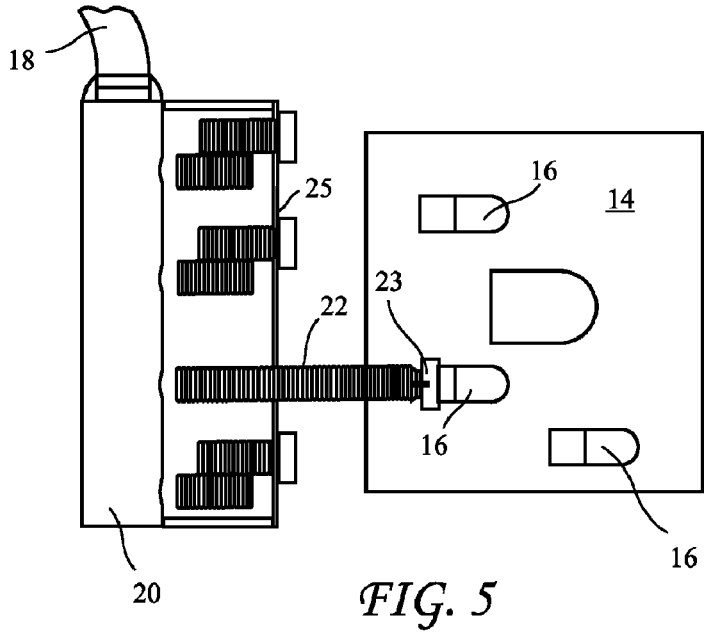
FIG. 5 is a top view of the manipulator arm and manifold according to the present invention with one of the flexible ducts attached to a corresponding OGV exhaust pipe.

FIG. 4 is a side view of the manipulator 32 suspended from a crane or other device 24, with the manifold 20 suspended by the same device or by another crane or other device 24, and the top of the OGV stack 14 to the right with one OGV exhaust pipe 16 shown, and FIG. 5 is a top view of the manifold 20 and parallel-flow flexible ducts 22 with one of the parallel-flow flexible ducts 22 connected to a corresponding one of the OGV exhaust pipes 16. The unattached ones of the parallel-flow flexible ducts 16 hang from the manifold 20 in a loop, with the free ends 23 carried by a cradle 25 attached to the manifold 20. Alternatively, the parallel-flow flexible ducts may be stowed in a manifold or receptacle, not shown, into which the flexible duct is collapsed when not in use or needed to accommodate OGV motion.

Three additional parallel-flow flexible ducts 22 await deployment. While in the docked state, the additional parallel-flow flexible ducts 22 may be blanked or sealed with a valve or cap to prevent ambient air ingestion into the manifold 20. The manipulator 32 may be attached to the same crane or other structure 24 as the manifold 20, or two separate cranes (or other lifting devices) 24 may support the manipulator 32 and the manifold 20.

Figure 6C:
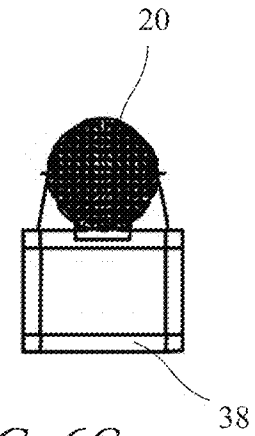
FIGS. 6A-6C show side, top, and end views of the manifold according to the present invention.
Figure 6B:
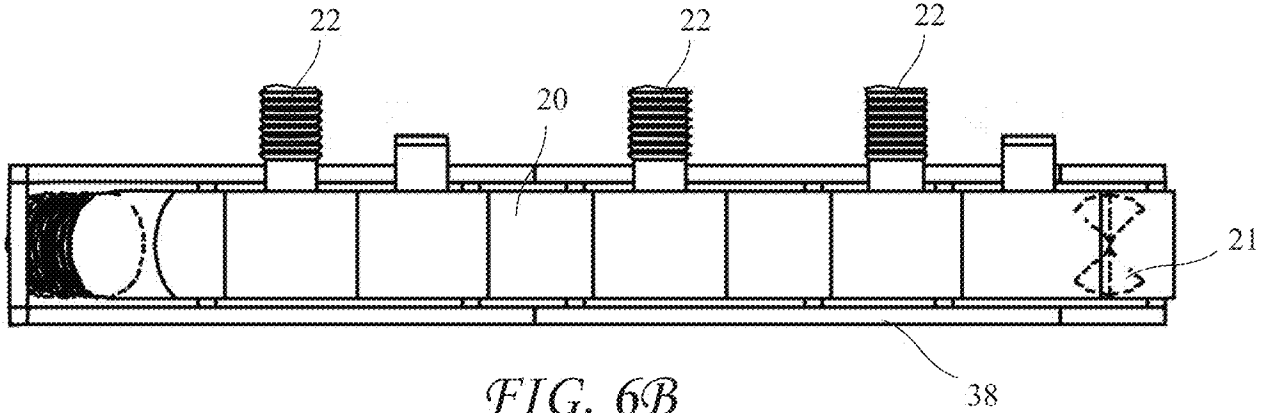
Figure 6A:
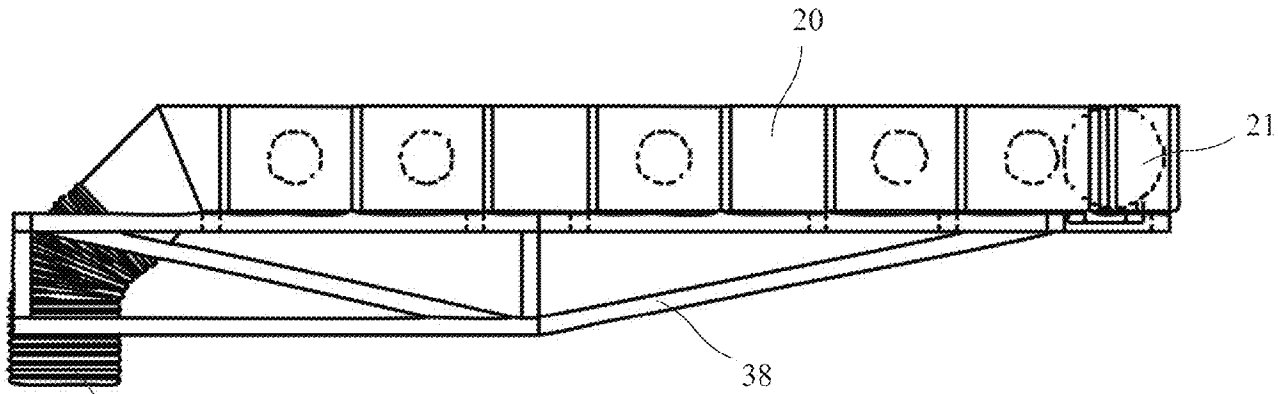

FIGS. 6A-6C show side, top, and end views respectively of one embodiment of the manifold 20. Three of the parallel-flow flexible ducts 22 are shown, and three active OGV exhaust pipes 16 are the most common configuration for commercial ships, but two additional manifold inlets are available for less common OGV exhaust pipe 16 configurations with four to five active exhaust pipes. The manifold 20 and parallel-flow flexible ducts 22 are pre-configured on the ground prior to being lifted up to the OGV exhaust pipe 16 elevation. Manifold inlets which are not used are capped at this time.

A further unique aspect of the exhaust capture system 10 is the means of connecting the parallel-flow flexible ducts 22 to the OGV exhaust pipes 16. Any such connection may include some combination of an alignment means, a securing means, and a means to open and close the parallel-flow flexible duct 22 with a valve depending upon whether it is docked in a cradle or other device, or connected to an exhaust pipe 16, or being transported prior to such connection. The manipulator arm 32 may be used to remove each parallel-flow flexible duct 22 from its dock and place it over an exhaust pipe 16. This placement action may include multiple tasks such as releasing or closing a latch, opening or closing a valve, aligning the flexible duct 22 with and placing it in or over the exhaust pipe 16, latching or otherwise securing it to the exhaust pipe 16, and effecting a seal between the flexible duct 22 and the exhaust pipe 16 to eliminate or minimize exhaust gas leakage to atmosphere.

Figure 7:
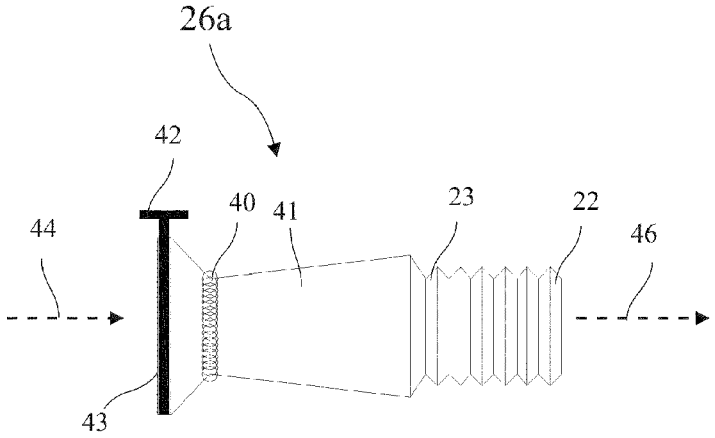
FIG. 7 depicts a first embodiment of an end connector (or coupling) according to the present invention having a slip fit over the exhaust pipe and a belt or spring for cinching the coupling on the OGV exhaust pipe.

FIG. 7 depicts a first embodiment of the end connector (or coupling) 26 comprising a flexible connector (or sock connector) 26*a* attached to the free end 23 of the flexible duct 22 according to the present invention. One end of the flexible connector 26*a* is connected to the free end 23 of one of the parallel-flow flexible ducts 22. The opposite end 43 of the flexible connector 26*a* includes both a lifting handle 42 and an attachment to fit over the OGV exhaust pipe 16. The lifting handle 42 may or may not include a means to open or close the attachment over (or into) the OGV exhaust pipe 16 and/or to secure the flexible connector 26*a* to the OGV exhaust pipe 16. A sleeve (or flexible connecting portion) 41 extends the length of the flexible connector 26*a* and a belt (for example a spring) 40 around the sleeve 41 expands radially outward as the connector is pulled over the OGV exhaust pipe 16 by the manipulator arm 32 or other means. Once in place over the OGV exhaust pipe 16, the belt 40 holds the flexible connector 26*a* in a firm connection.

The sleeve 41 tapers slightly from the open end which fits over the OGV exhaust pipe 16 to the opposite end which is connected to the free end 23 of the corresponding parallel-flow flexible ducts 22. The flexible connecting piece 26*a* is pulled over the OGV exhaust pipe 16 by the manipulator arm 32. The belt 40 may be an annular coil spring or elastomeric band encircling the sleeve 41 near its midpoint and squeezing the sleeve 41 around the outside surface of the OGV exhaust pipe 16, ensuring a secure attachment. An alternative to the spring or elastomeric band is a circular band, similar to a hose clamp, which is tightened by the manipulator after the flexible connecting piece 26*a* is positioned over the exhaust pipe. The belt 40 may alternatively be a steel strap clamp attached to the sock and having adjustable circumference, the steel strap clamp actuated by a robotic manipulator arm by actuating a lever which actuates a mechanism which may be a cam, a take-up spool and latch mechanism, or a tightening screw to tighten the sleeve on the OGV exhaust pipe.

Figure 8:
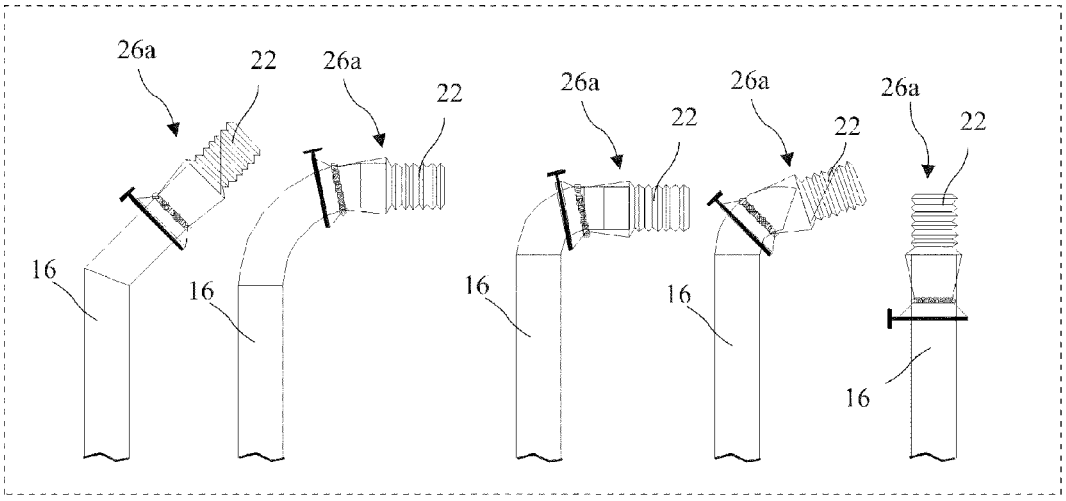
FIG. 8 shows several OGV exhaust pipe configurations according to the present invention with the flexible duct attached to each exhaust pipe by the first coupling described in FIG. 7.

FIG. 8 shows several OGV exhaust pipe 16 configurations with the flexible connecting piece 26*a* attached to the OGV exhaust pipe 16 by the method described above.

Figure 9A:
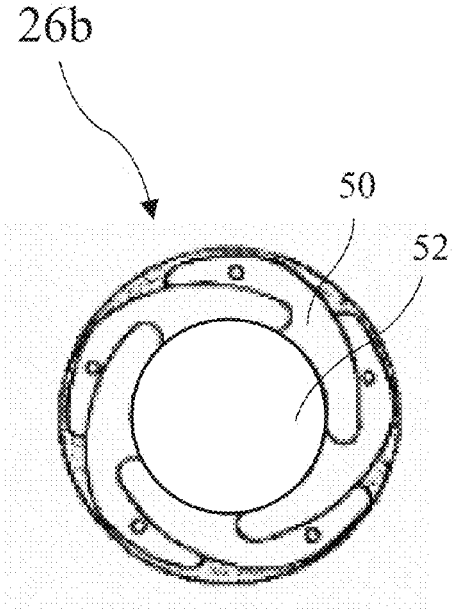
FIGS. 9A and 9B depict a second embodiment of a coupling comprising an iris-type coupling according to the present invention, which may be closed over the exhaust pipe by action of the manipulator arm.
Figure 9B:
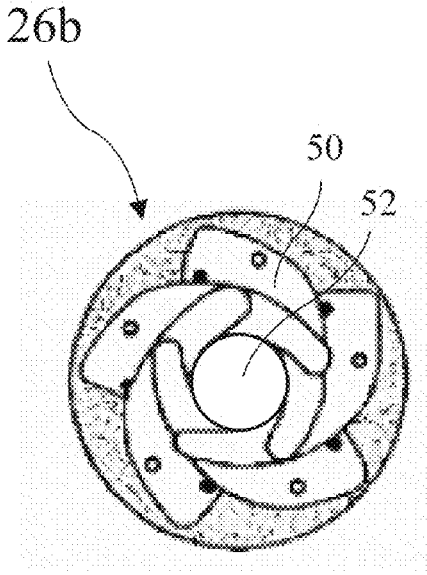
Figure 10D:
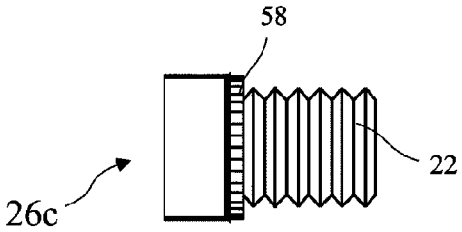
FIGS. 10A-10D depict side, front, rear, and top views of a third embodiment of a coupling according to the present invention comprising a magnetic coupling according to the present invention utilizing a ring of permanent magnets for holding the flexible duct against the end of the exhaust pipe.
Figure 10B:
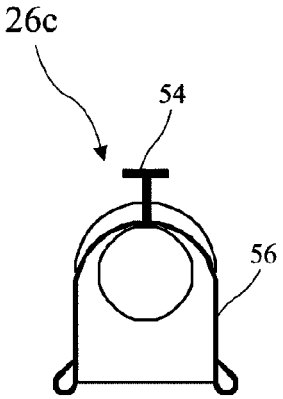
Figure 10A:
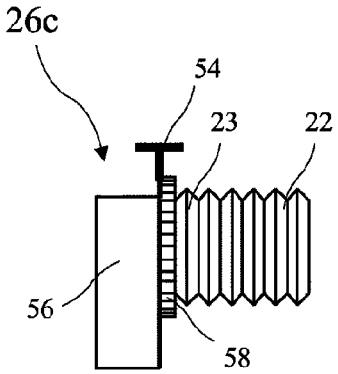
Figure 10C:
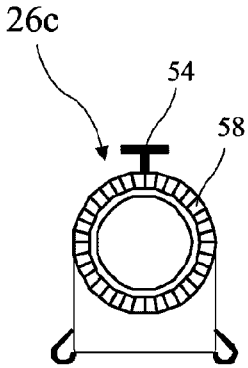

FIG. 9A shows a second embodiment of the connector comprising an iris-type connector 26*b* in an open position, and FIG. 9B shows the iris-type connector 26*b* in a closed position. The iris-type connector 26*b* is similar to the aperture in some cameras and includes blades 50 which close around the exterior of the OGV exhaust pipe 16 and hold the iris-type connector 26*b* and thus the parallel-flow flexible duct 22 in place. The iris-type connector 26*b* may be actuated into the open state by the act of the manipulator 32 picking up one of the parallel-flow flexible duct 22 handles, and actuate the iris-type connector 26*b* into the closed state over the OGV exhaust pipe 16 by the act of the manipulator arm 32 releasing the lifting handle. The manipulator arm 32 may alternatively actuate the iris-type connector 26*b* by turning a handle or lifting a lever after the iris-type connector 26*b* is in place over the OGV exhaust pipe 16, or by other means. The closing actuation may also be accomplished by the manipulator arm 32 squeezing or rotating a lever or handle or by other means.

FIG. 10A-10D show front, side, rear, and top views respectively of a third embodiment of the connecting device comprising a magnetic connector 26*c*. The magnetic connector 26*c* utilizes a ring of permanent magnets 58 which are attracted to and which hold the magnetic connector 26*c* against a respective one of the OGV exhaust pipes 16. A U-shaped bracket 56 locates the magnetic connector 26*c* and the ring of magnets 58 in alignment with the OGV exhaust pipe 16 while the magnets 58 are too far away from the OGV exhaust pipe 16 to be attracted to it. The manipulator arm 24 then moves the magnetic connector 26*c* toward the OGV exhaust pipe 16 until the magnets 58 make contact with the OGV exhaust pipe 16.

The magnets 58 are in the form of a ring concentric with the flexible duct 22. An upside-down U-shaped yoke 56, held and positioned by the manipulator arm 32, centers the magnetic connector 26*c* and the parallel-flow flexible duct 22 over the OGV exhaust pipe 16, then the manipulator 32 moves the magnetic connector 26*c* and attached parallel-flow flexible duct 22 forward until the magnets 58 are drawn to the end of the OGV exhaust pipe 16.

Figure 11:
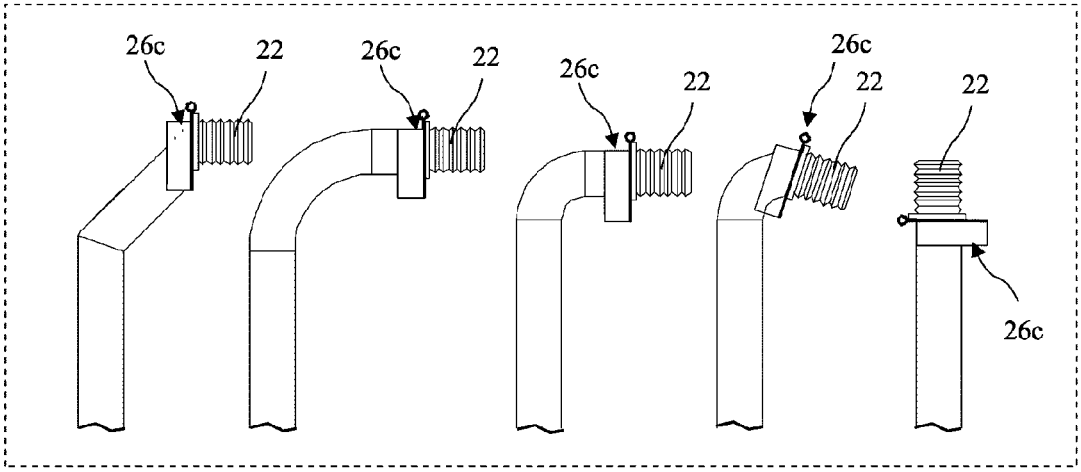
FIG. 11 depicts the magnetic coupling according to the present invention attaching the flexible duct over OGV exhaust pipes of various configurations.

FIG. 11 shows various installations of the magnetic connector 26*c* to OGV exhaust pipes 16 of various configurations.

Figure 12:
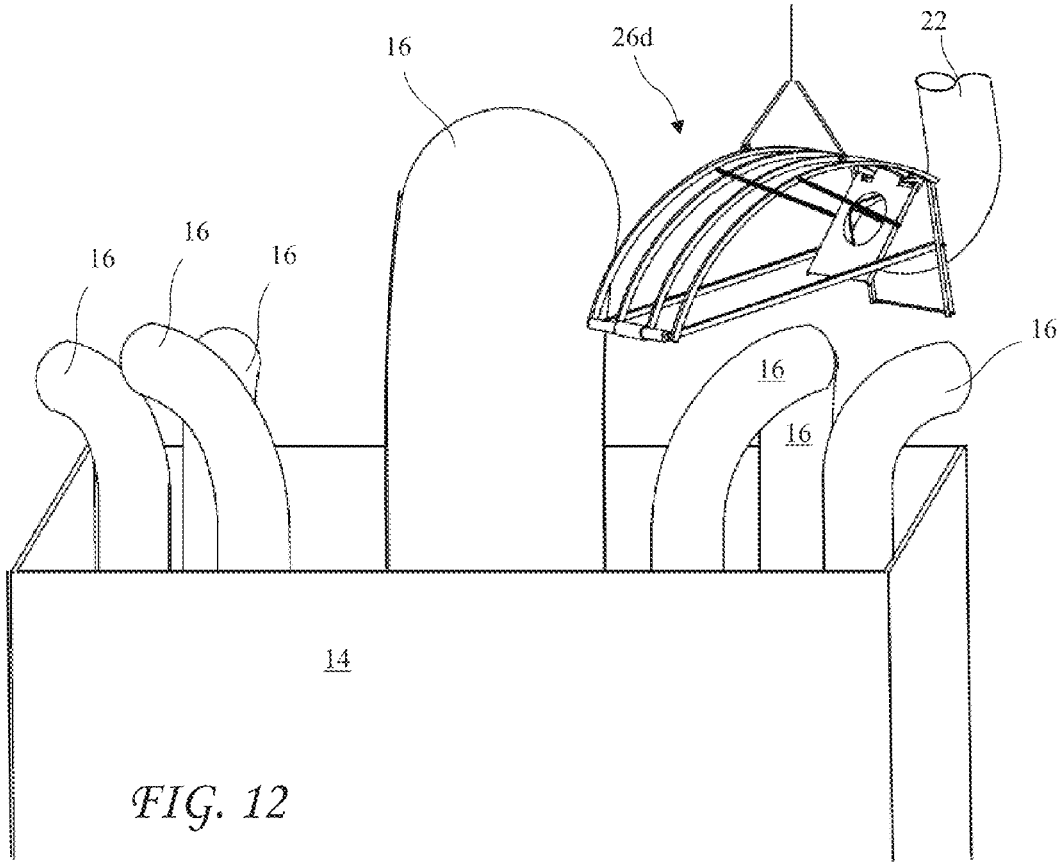
FIG. 12 shows an alignment cage type coupling according to the present invention attached to the end of one of the flexible ducts and positioned over one of the OGV exhaust pipes.
Figure 12A:
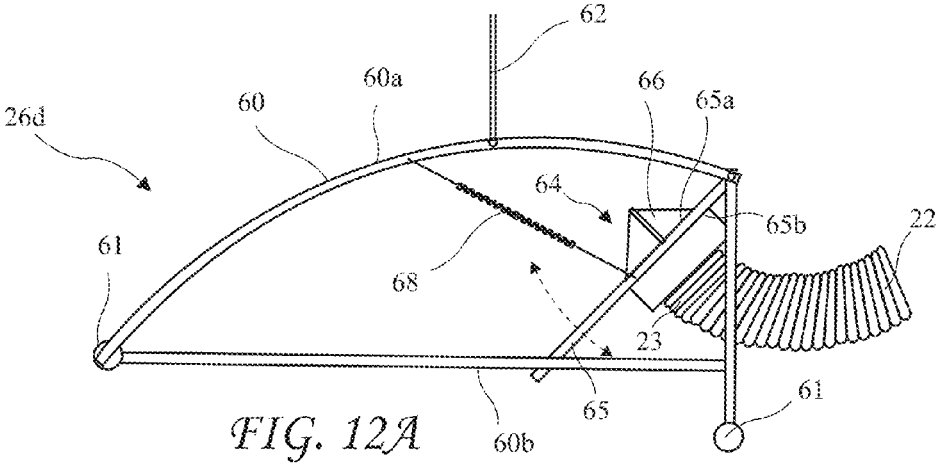
FIG. 12A shows a side view of the alignment cage type coupling according to the present invention.

FIG. 12 shows a perspective view of a fourth embodiment of the connecting device comprising a cage connector 26*d* and FIG. 12A shows a detailed side view of the cage connector 26*d*. The cage connector 26*d* includes cage 60 with an open bottom and an arced ceiling 60*a*. When the cage 60 is lowered over a respective one of the OGV exhaust pipes 16, the arced ceiling 60*a* tends to guide the cage into position on the OGV exhaust pipes 16. The free end 23 of the parallel-flow flexible ducts 22 is attached to one end of the cage connector 26*d* to an interface plate mechanism 64.

The interface plate mechanism 64 comprises a hinged flat plate 65 with a hole in the center slightly smaller in diameter than the OGV exhaust pipe 16. A front face 65*a* of the interface plate 65 includes a centering cross 66 which preferably is pointed for aligning with the OGV exhaust pipe 16 and one of the parallel-flow flexible ducts 22 is attached to a rear face 65*b* of the interface plate 65. A pair of lower parallel tubes forming sides of the bottom 60*b* of the cage 60 straddle the OGV exhaust pipe 16, and as the cage 60 is lowered over the OGV exhaust pipe 16, and the curved tubes forming the ceiling 60*a* of the cage 60 cause the cage 60 to glide over the OGV exhaust pipe 16 and slide down until the interface plate 65 (centered by the centering cross 66) making contact with an open end of the OGV exhaust pipe 16. The interface plate 65 is pulled forward by springs 68 and the weight of the cage connector 26*d* seats the interface plate 65 against the open end of the OGV exhaust pipe 16, thereby directing the exhaust gas into the parallel-flow flexible duct 22. The lower end of the cage 60 is weighted by weights 61 to facilitate this process.

Figure 13:
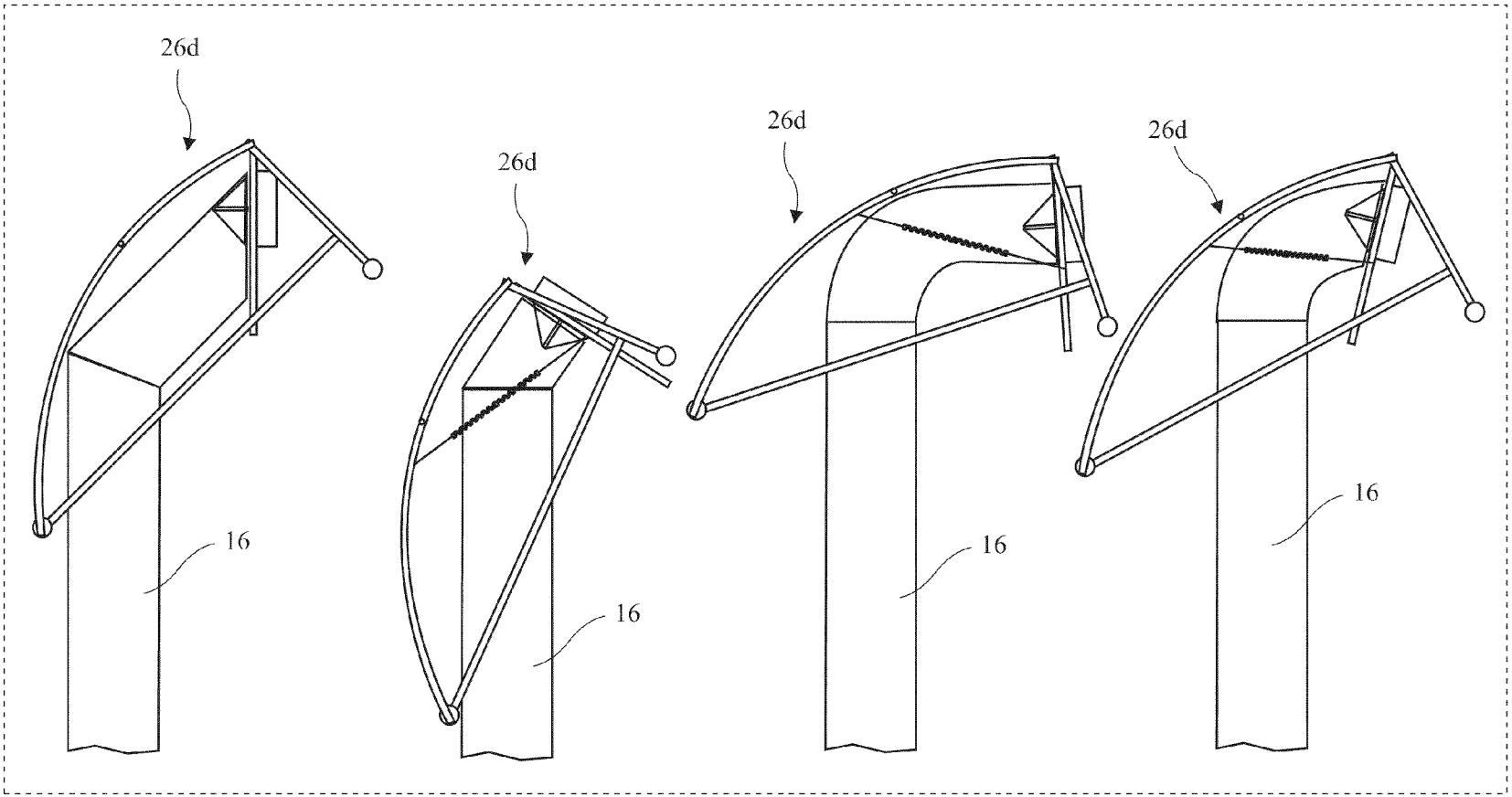
FIG. 13 shows the alignment cage deployed over a variety of OGV exhaust pipe configurations according to the present invention.

FIG. 13 shows the cage connector 26*d* fully deployed over a variety of OGV exhaust pipe 16 configurations. The method of use of the cage connector 26*d* may only require that the cage connector 26*d* be positioned directly above the OGV exhaust pipe 16 for deployment, thereby eliminating the need for a positional axis in the horizontal direction by the crane or other placement device. In order to position the connector over the OGV exhaust pipe.

Figures 14A, 14B:
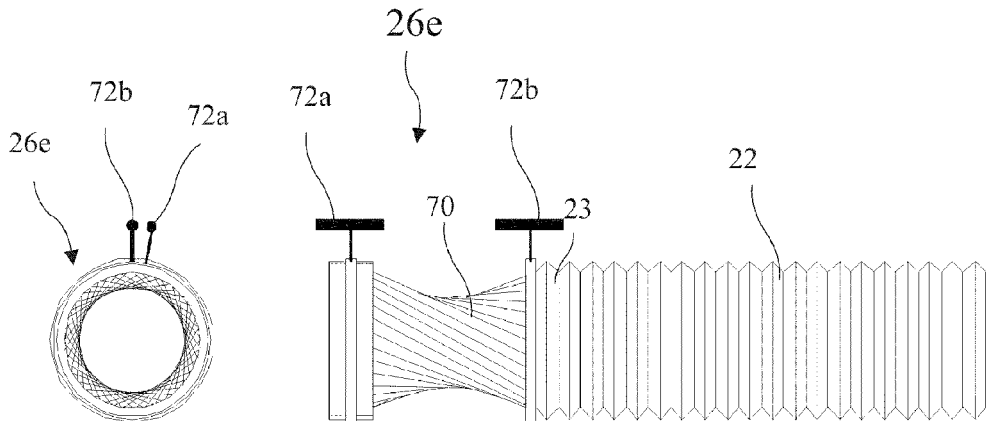
FIGS. 14A and 14B depict side and front views of a contacting flexible tube (or sock) connector according to the present invention in a relaxed contracted condition for securing the flexible duct to the OGV exhaust pipe.
Figures 15A, 15B:
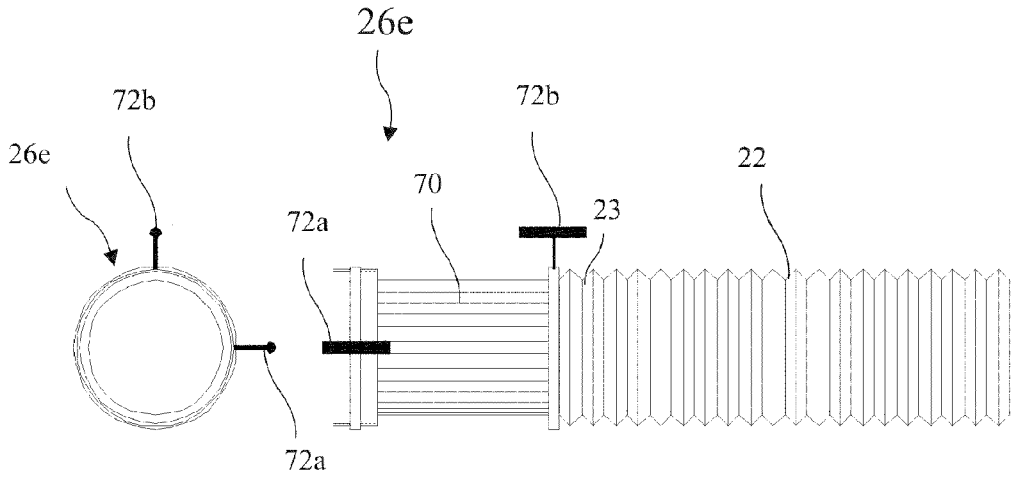
FIGS. 15A and 15B depict side and front views of the flexible tube connector according to the present invention in a twisted condition to open for placing over the OGV exhaust pipe.

FIG. 14A shows a side view of a fifth embodiment of the connecting device comprising a flexible tube (or sock) connector 26*e* in a closed state wherein the connector 26*e* is twisted or rotated to constrict or squeeze down in a center portion 70 for tightening and sealing on the OGV exhaust pipe 16 when one end is rotated relative to the other end, and FIG. 14B shows an end view of the flexible tube connector 26*e* twisted into the closed state. FIG. 15A shows a side view of the a flexible tube connector 26*e* in an open state wherein the connector 26*e* is relaxed in open to fit over an OGV exhaust pipe 26, and FIG. 15B shows an end view of the relaxed flexible tube connector 26*e* in the open state. In a preferred embodiment, the action of the manipulator arm 32 lifting the flexible tube connector 26*e* by handles (or twist grips) 72*a* and 72*b* from the dock 25 actuates the flexible tube connector 26*e* into the open state so the flexible tube connector 26*e* may be placed over the OGV exhaust pipe 16. Releasing the handle 72*a* and 72*b* actuates the flexible tube connector 26*e* into the closed state securing the flexible tube connector 26*e* to the OGV exhaust pipe 16. The center portion 70 is preferably a fabric cylinder and the handle 72*a* is preferably attached to the end of the fabric cylinder opposite the flexible duct 22 by a ring which is rotatable relative to the end of the flexible duct 22 and a latch is provided to hold the rotatable end of the fabric cylinder in the rotated position to hold a seal on the OGV exhaust pipe 16, wherein releasing the latch releases the rotatable end allowing the coupling 26*e* to be pulled away from the OGV exhaust pipe 16.

At least four different actuation methods are contemplated for the flexible tube connector 26*e*. In the first method, when the manipulator arm 32 picks up the flexible tube connector 26*e* by the handles 72*a* and 72*b*, the flexible tube connector 26*e* opens or remains open, and when the manipulator arm 32 lowers the lifting handles 72*a* and 72*b* and places the flexible tube connector 26*e* over the OGV exhaust pipe 16, a spring or weight mechanism twists the flexible tube connector 26*e* to close the flexible tube connector 26*e* over the OGV exhaust pipe 16 and holds the flexible tube connector 26*e* in the closed position until removed by the manipulator arm 32 moving handle 72*a* into the position shown in FIG. 15A. One such a mechanism is an extension spring and another possible configuration is a coil spring. Either spring tends to wind the sock into the closed state shown in FIG. 14A when the manipulator arm releases the handle 72*a*. Ribs in the sock allow twisting motion necessary for closure, but not a linear collapse of end 72*a* into end 72*b*.

A second method has the manipulator arm pull the end of the sock over the exhaust pipe with handle 72*a*, then a second action would rotate the end of the sleeve connected to the flexible duct with handle 72*b* to contract the flexible tube connector 26*e* to the closed state.

In the third actuation method, the flexible tube connector 26*e* is relaxed in the closed state until the manipulator arm 32 forces a relative rotation between the handles 72*a* and 72*b* to transition the flexible tube connector 26*e* to the open state, after which a latch, for example one which extends between handles 72*a* and 72*b*, is actuated to hold the flexible tube connector 26*e* in the open state. After the flexible tube connector 26*e* is positioned over the OGV exhaust pipe 16, the latch is released to tighten the flexible tube connector 26*e* over the OGV exhaust pipe 16.

The fourth method replaces the sock with a gradually tapered elastomeric tube. The elastomeric tube is pulled over the OGV exhaust pipe 16 by handle 72*a* until the inner bore of the elastomeric tube makes firm contact with the outer diameter of the OGV exhaust pipe 16, at which time handle 72*a* is rotated as shown in FIG. 15A. The rotation causes the elastomeric tube to contract in cross section to the closed state, sealing it around the OGV exhaust pipe 16. A latch holds the handle 72*a* in the rotated closed state until it is released by the manipulator arm prior to removal of the elastomeric tube from the OGV exhaust pipe 16.

Figure 16:
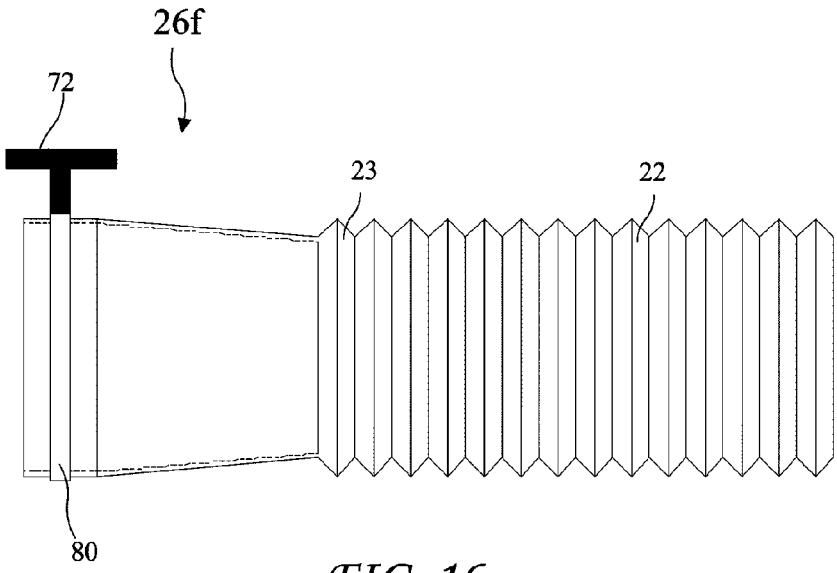
FIG. 16 depicts a tapered elastomeric tube connector according to the present invention which may be pushed over the end of the OGV exhaust pipe by the manipulator and held in place by friction.

FIG. 16 shows a side view of a sixth embodiment of the connecting device comprising a tapered elastomeric tube connector 26*f* which is pushed over the end of the OGV exhaust pipe 16 by the manipulator 32 to secure and seal the respective parallel-flow flexible duct 22 to the respective OGV exhaust pipe 16. The tapered elastomeric tube connector 26*f* is fixed to the end of the respective parallel-flow flexible duct 22, and to a cinching band 80 attached to the handle 72. The cinching band 80 is tightened by the manipulator arm by, for example, a rotating motion similar to tightening a radiator hose clamp, causing it to tighten about the OGV exhaust pipe 16.

Figure 17:
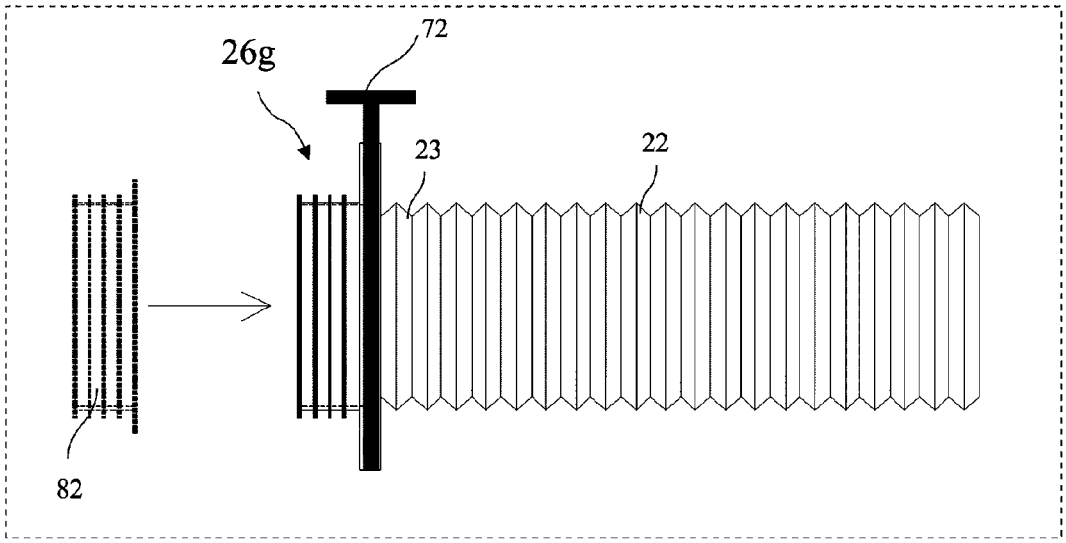
FIG. 17 shows a ribbed plug connector according to the present invention which fits into the OGV exhaust pipe with ribs effecting a tight seal to the exhaust pipe inside diameter.

FIG. 17 shows a side view of a seventh embodiment of the connecting device comprising a ribbed plug connector 26*g* which fits into the OGV exhaust pipe 16. A different end piece 82 is required for each different OGV exhaust pipe 16 diameter. The manipulator arm 32 may be used to force the ribbed plug connector 26*g* into the end of the OGV exhaust pipe 16. The ribs are forced to deflect inside the exhaust pipe, forming a seal and creating sufficient resistance to hold the plug in the exhaust pipe. The ribbed plug connector 26*g* is preferably made from an elastomeric material.

Figure 18:
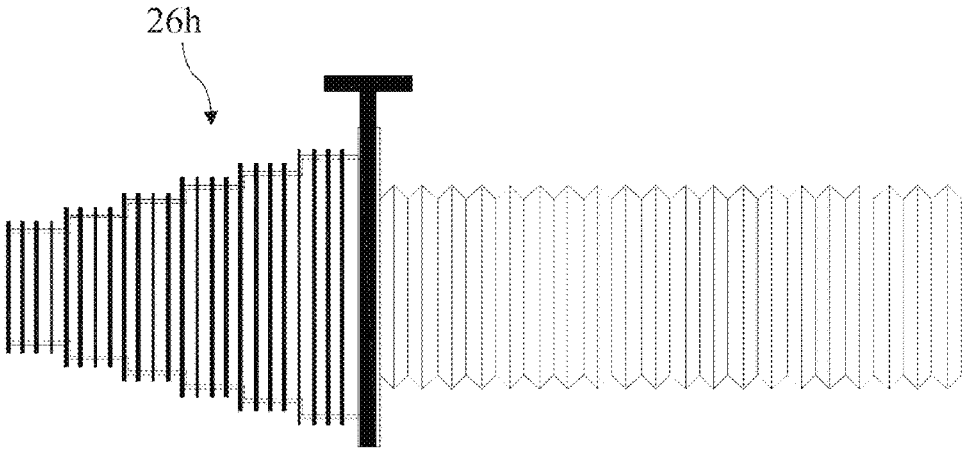
FIG. 18 shows a stepped plug-type connector according to the present invention with different diameters capable of being inserted into a variety of different OGV exhaust pipe diameters, each plug having ribs which flex to form a seal when the plug is inserted into the OGV exhaust pipe.

FIG. 18 shows a side view of a seventh embodiment of the connecting device, which is a variation of the sixth embodiment, comprising a stepped-plug type connector 26*h* having stepped diameters capable of being inserted into a variety of different OGV exhaust pipe 16 diameters. The stepped-plug type connector 26*h* is attached by inserting a stepped-plug type connector 26*h* into the OGV exhaust pipe 16. Ribs on the outside of the stepped-plug type connector 26*h* enhance the holding power of the stepped-plug type connector 26*h*. The stepped-plug type connector 26*h* may be fabricated in discreet sections so that a minimum length of stepped-plug type connector 26*h* can be used for each individual OGV exhaust pipe 16. The stepped-plug type connector 26*h* is preferably made from an elastomeric material.

Figure 19:
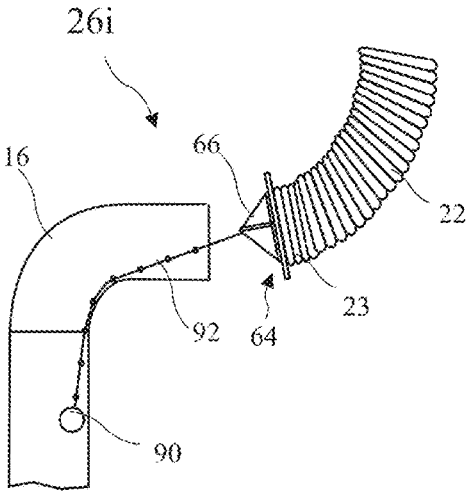
FIG. 19 shows a ball weighted cable according to the present invention which pulls the flexible duct flush with the open end of the OGV exhaust pipe, an elastomer or other sealing surface on the end of the flexible duct mates with the end of the exhaust pipe and is held in intimate contact with it by the weight.

FIG. 19 shows a side view of an eighth embodiment of the connecting device comprising a weighted connector 26*i* which includes a weight 90 which pulls a leash 92 which pulls the weighed connector 66 on the free end 23 of the parallel-flow flexible duct 22 flush with the open end of the OGV exhaust pipe 16. A front face 65*a* of the interface plate 65 of the interface plate mechanism 64 (see FIG. 12A) includes a centering cross 66 which preferably is pointed for aligning with the OGV exhaust pipe 16 and one of the parallel-flow flexible ducts 22 is attached to a rear face of the interface plate mechanism 64. The weighted connector 26*i* may require a secondary arm on the manipulator 32, not shown, to release the ball or weight 90 from its stowed location inside the parallel-flow flexible duct 22, or attached to the interface plate mechanism 64, once the duct is in position at the end of the OGV exhaust pipe 16.

In another configuration the ball 90 is carried inside the flexible duct 22 and held in place by a latch which is released when the guide 66 makes contact with the end of the exhaust pipe 16. Tripping this latch releases the weight 90 and may simultaneously give the weight 90 a push into the exhaust pipe 16. Releasing the weight 90 causes the weight 90 to drop into the open end of the OGV exhaust pipe 16. Once the weight 90 is dropped into the OGV exhaust pipe 16, no further action is required to complete and maintain the connection to the OGV exhaust pipe 16. An elastomeric gasket preferably resides on the end of the respective parallel-flow flexible duct 22 to provide a gas tight seal.

The weight 90 may, for example, be a ball at the end of a cable. The leash 92 may alternatively be a heavy multiple segment cable, or a series of weights strung on a cable, and any weight and leash which do not snag on bends in the OGV exhaust pipe. The end of the flexible duct 22 may alternatively be attached to a tapered elastomeric sleeve similar to that shown in FIG. 7 and FIG. 16, wherein the weight 90 falling into the exhaust pipe 16 pulls the tapered tube over the exhaust pipe 16 to provide a seal. Any connecting device which includes a heavy object dropped into the exhaust pipe 16, the weight 90 sufficient to pull and hold any connector at the end of the parallel-flow flexible duct 22 against the end of the OGV exhaust pipe 16, is intended to come within the scope of the present invention.

In another embodiment, individual steel balls are attached to the leash at close, regular intervals, which increases the ease of traversing bends in the exhaust pipe. A second parallel leash may be attached to each ball which acts as a safety wire to prevent one or more of the balls from coming loose from the main cable and falling down the exhaust pipe.

Figure 20:
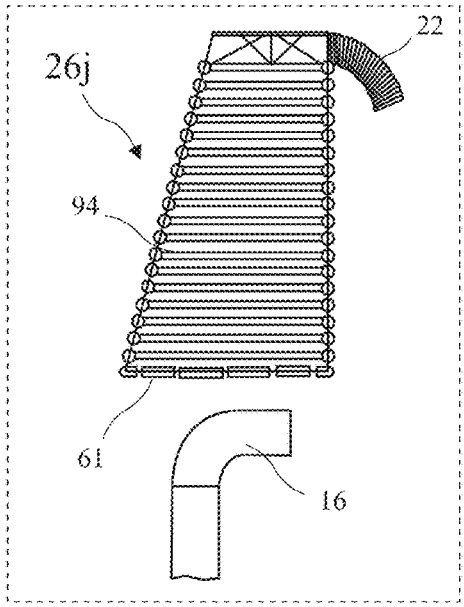
FIG. 20 shows a drape type apparatus according to the present invention on the end of the flexible duct which is placed over the outside of the OGV exhaust pipe, and drapes over the exhaust pipe to capture exhaust, the drape weighted to pull a sealing surface on the end of the flexible duct into contact with the end of the exhaust pipe.

FIG. 20 shows a side view of a ninth embodiment of the connecting device comprising a drape connector **26*j* which is placed over the outside of the OGV exhaust pipe 16, and which then slithers down the OGV exhaust pipe 16, pulling the end plate connected to the parallel-flow flexible duct 22 over and flush with the open end of the OGV exhaust pipe 16. The drape 94 is constructed from beads or rollers strung between two parallel cables which straddle the exhaust pipe. The drape 94 envelopes a half diameter or more of the OGV exhaust pipe 16, and as the drape 94 slides or slithers down the outside of the OGV exhaust pipe 16 the drape 94 pulls the respective parallel-flow flexible duct 22 into place at the end of the respective OGV exhaust pipe 16. An elastomeric gasket on the end of the flexible duct provides a gas tight seal. Weights 61 help pull the drape 94 down over the respective OGV exhaust pipe 16. The drape connector 26*j* may further include elements of the interface plate mechanism 64 for engaging the parallel-flow flexible duct 22 with the OGV exhaust pipe 16**.

Instances of the present invention including flexible connector (or socks) positioned over the OGV exhaust pipe 16 preferably have a relaxed state in which the flexible connectors may be pulled off the OGV exhaust pipes 16 for easy removal in an emergency.

Examples of suitable emissions treatment systems are described in U.S. Pat. No. 7,258,710 for "Maritime Emissions Control System", U.S. Pat. No. 7,275,366 for "High Thermal Efficiency Selective Catalytic Reduction (SCR) System", and U.S. patent application Ser. No. 11/092,477 for "Air Pollution Control System for Ocean-going Vessels". The '366 patent and '477 application are herein incorporated by reference in their entirety and the '710 was incorporated above.

While the invention herein disclosed has been described by means of specific embodiments and applications thereof, numerous modifications and variations could be made thereto by those skilled in the art without departing from the scope of the invention set forth in the claims.

We claim:

1. An Ocean Going Vessel (OGV) exhaust gas capture system comprising: a plurality of parallel-flow flexible ducts connectable to individual corresponding OGV exhaust pipes to capture exhaust flows from the OGV exhaust pipes;

a plurality of connectors on free ends of the parallel-flow flexible ducts for connecting and sealing the parallel-flow flexible ducts to the OGV exhaust pipes;

a manifold connected to fixed ends opposite the free ends of the plurality of parallel-flow flexible ducts and receiving all of the exhaust flows captured by the plurality of parallel-flow flexible ducts from the OGV exhaust pipes;

a main duct connected to the manifold receiving all of the exhaust flows from the OGV exhaust pipes;

an emissions treatment system connected to the main duct and receiving all of the exhaust flows from the OGV exhaust pipes for processing the exhaust flows to reduce pollution in the exhaust flows;

sensors for determining positions of the plurality of parallel-flow flexible ducts and the OGV exhaust pipes; and a robotic arm apparatus for positioning and connecting the OGV exhaust gas capture system.

2. The OGV exhaust gas capture system of claim 1, wherein the OGV exhaust gas capture system is operable from a platform selected from the group consisting of a shore-based platform and a water-based platform.

3. The OGV exhaust gas capture system of claim 1, wherein the parallel-flow flexible ducts have a small cross-section reducing wind forces on the parallel-flow flexible ducts thereby reducing the difficulty of effecting and maintaining connection to the source of exhaust gas while simultaneously minimizing the possibility of damaging either of the ship and ship auxiliary structures due to either of wind-induced motion and to swinging during placement and attachment of the capture device.

4. The OGV exhaust gas capture system of claim 3, wherein the individual parallel-flow flexible ducts each have approximately a one foot diameter.

5. The OGV exhaust gas capture system of claim 1, wherein the individual parallel-flow flexible ducts have sufficient length to accommodate OGV motions due to wind, tides, and cargo loading and unloading while maintaining connection to the OGV exhaust pipes.

6. The OGV exhaust gas capture system of claim 5, wherein the individual parallel-flow flexible ducts have a length of at least 20 feet.

7. The OGV exhaust gas capture system of claim 1, wherein the connector comprises:

flexible sock connections on ends of each of the individual parallel-flow flexible ducts which are slipped over the OGV exhaust pipe; and an annular belt around each sock connection toward a rear end of each sock connection and pulled over the OGV exhaust pipe to secure the individual parallel-flow flexible ducts to the OGV exhaust pipe while simultaneously providing a gas tight seal, wherein the sock connections are pulled onto the end of the OGV exhaust pipes by a manipulator arm and accommodate a variety of pipe termination geometries.

8. The OGV exhaust gas capture system of claim 7, wherein the annular belt comprises a steel strap clamp attached to the sock and having adjustable circumference, the steel strap clamp actuated by a robotic manipulator arm by actuating a lever which actuates a mechanism selected from the group consisting of:

a cam;

a take-up spool and latch mechanism; and a tightening screw to tighten the sock on the OGV exhaust pipe.

9. The OGV exhaust gas capture system of claim 1, wherein the connector comprises:

flexible sock connections on ends of each of the individual parallel-flow flexible ducts and slipped over the OGV exhaust pipe; and a pair of horseshoe-shaped semicircular flat springs attached to the sock and separated at the bottom and pressed over the OGV exhaust pipe and snap into place, the semicircular flat springs securing the sock over the OGV exhaust pipe and providing a nearly continuous seal around the OGV exhaust pipe circumference.

10. The OGV exhaust gas capture system of claim 1, wherein the connector comprises:

an iris valve type of clamp and sealing mechanism fitted to the end of the flexible duct, the iris valve serving multiple functions of:

acting as a valve to close off the parallel-flow flexible duct when the parallel-flow flexible duct is docked on the manifold;

providing a reasonably tight seal to the exhaust pipe when connected; and providing a clamping force to hold the device and the flexible duct to the exhaust pipe; and a lifting handle attached to the coupling and operatively connected to the iris valve, wherein the iris valve is actuated to an open state by the action of a manipulator arm picking up the lifting handle to remove the parallel-flow flexible duct from its docking station to connect to the OGV exhaust pipe, and wherein the iris valve is actuated to a closed state and closes around the OGV exhaust pipe when the manipulator arm releases the lifting handle.

11. The OGV exhaust gas capture system of claim 1, wherein the connector comprises a ring of magnets for holding the flexible duct to an open end of steel OGV exhaust pipes.

12. The OGV exhaust gas capture system of claim 1, wherein the connector comprises a locating framework and a spring-loaded interface plate, a lower end of the framework weighted to hold the coupling in place on the OGV exhaust pipe, the framework including sides and an arced ceiling for cooperation with the OGV exhaust pipe exterior surface to guide the coupling downward until the spring-loaded plate makes contact with an open end of the exhaust pipe, the weight continuing to pull the coupling downward until the spring-loaded plate is in intimate contact with the end of the exhaust pipe, the spring-loaded plate having a hole in the center for aligning with a mouth of the exhaust pipe.

13. The OGV exhaust gas capture system of claim 1, further including a manipulator arm; and wherein the connector comprises a cylindrical twist-grip for connecting the flexible duct to the OGV exhaust pipe, the twist-grip comprising a flexible material selected from the group consisting of a fabric sleeve and an elastomeric sleeve, the twist grip attached to the free end of the flexible duct and a rigid ring attached to an opposite rotatable end of the sleeve, the manipulator arm connected to the rotatable the end of the fabric cylinder, wherein rotating the rotatable end causes the fabric sleeve to contract in a sleeve center and tighten about the OGV exhaust pipe, simultaneously sealing and attaching the coupling to the OGV exhaust pipe.

14. The OGV exhaust gas capture system of claim 1, wherein the connector includes:

a coupling selected from the group consisting of:

an elastomeric rigid cone shaped coupling attached to the flexible duct with a gradual taper becoming smaller away from the open end which is slipped over the end of the OGV exhaust pipe until a firm seal is realized; and an elastomeric coated rigid cone shaped coupling attached to the flexible duct with a gradual taper becoming smaller away from the open end which is slipped over the end of the OGV exhaust pipe until a firm seal is realized; and a handle attached to the cone near the large end for lifting and positioning; and wherein the elastomeric cone has an annular clamp around the outside diameter which is tightened by action of a manipulator arm and which secures the elastomeric cone to the exhaust pipe.

15. The OGV exhaust gas capture system of claim 1, wherein the connector comprises:

a coupling selected from the group consisting of:

an elastomeric steel cone shaped coupling attached to the flexible duct with a gradual taper becoming smaller away from the open end which is slipped over the end of the OGV exhaust pipe until a firm seal is realized; and an elastomeric coated steel cone shaped coupling attached to the flexible duct with a gradual taper becoming smaller away from the open end which is slipped over the end of the OGV exhaust pipe until a firm seal is realized; and a handle attached to the cone which is used to lift and position the cone and which includes a twisting or levering mechanism to tighten a clamp which secures the tapered cone to the outside of the OGV exhaust pipe.

16. The OGV exhaust gas capture system of claim 1, wherein the connector comprises:

a coupling selected from the group consisting of:

an elastomeric rigid cone with the diameter becoming larger away from the open end which is pushed into the OGV exhaust pipe, and which further includes ribs on the outside of the cone to increase the holding power of the cone inside the OGV exhaust pipe; and an elastomeric coated rigid cone with the diameter becoming larger away from the open end which is pushed into the OGV exhaust pipe, and which further includes ribs on the outside of the cone to increase the holding power of the cone inside the OGV exhaust pipe;

an end piece on each of the flexible ducts onto which different diameters of tapered, ribbed cone are attached to fit the various inside diameters of OGV exhaust pipes, and a lifting handle fitted onto the end piece for lifting the connector and pushing it into the OGV exhaust pipe and for subsequently retrieving it.

17. The OGV exhaust gas capture system of claim 1, wherein the connector comprises:

a weighted leash which is inserted into the open end of the OGV exhaust pipe, wherein the weighted leash pulls the flexible duct firmly against the open end of the OGV exhaust pipe, the weighted leash selected from the group consisting of:

a chain or cable with a heavy weight attached to the end which is dropped down the inside of the OGV exhaust pipe including;

a heavy weight attached to the end of the cable or chain; and individual spaced apart steel balls attached to the leash at close, regular intervals which increase the weight and the ease of traversing bends in the exhaust pipe; and an interface on the end on the flexible duct, the interface selected from the group consisting of:

a flat plate with an opening approximately the size of the OGV exhaust pipe bore and an elastomeric gasket to seal against the end of the OGV exhaust pipe;

three or more tapered ribs or a tapered cage which center the interface over the opening of the exhaust pipe;

a tapered elastomeric cone attached at its small end to the flexible duct and where the larger end is pulled over the open end of the OGV exhaust pipe by the weighted leash that has been dropped down the OGV exhaust pipe, the force of the weight sufficient to cause the elastomeric cone to form a seal to the outside diameter of the OGV exhaust pipe; and a tapered elastomeric coated cone attached at its small end to the flexible duct and where the larger end is pulled over the open end of the OGV exhaust pipe by the weighted leash that has been dropped down the OGV exhaust pipe, the force of the weight sufficient to cause the elastomeric cone to form a seal to the outside diameter of the OGV exhaust pipe.

18. An Ocean Going Vessel (OGV) exhaust gas capture system comprising:

a plurality of parallel-flow flexible ducts connectable to individual corresponding OGV exhaust pipes to capture exhaust flows from the OGV exhaust pipes;

a plurality of connectors on free ends of the parallel-flow flexible ducts for connecting and sealing the parallel-flow flexible ducts to the OGV exhaust pipes, the connectors comprising:

flexible sock connections on ends of each of the individual parallel-flow flexible ducts which are slipped over the OGV exhaust pipe; and an annular belt around each sock connection toward a rear end of each sock connection and pulled over the OGV exhaust pipe to secure the individual parallel-flow flexible ducts to the OGV exhaust pipe while simultaneously providing a gas tight seal, wherein the sock connections are pulled onto the end of the OGV exhaust pipes by a manipulator arm and accommodate a variety of pipe termination geometries;

a manifold connected to fixed ends opposite the free ends of the plurality of parallel-flow flexible ducts and receiving all of the exhaust flows captured by the plurality of parallel-flow flexible ducts from the OGV exhaust pipes, the individual ducts have about a one foot diameter and a length of at least 20 feet;

a main duct connected to the manifold receiving all of the exhaust flows from the OGV exhaust pipes;

an emissions treatment system connected to the main duct and receiving all of the exhaust flows from the OGV exhaust pipes for processing the exhaust flows to reduce pollution in the exhaust flows;

sensors for determining positions of the plurality of parallel-flow flexible ducts and the OGV exhaust pipes; and a robotic arm apparatus for positioning and connecting the OGV exhaust gas capture system.

19. An Ocean Going Vessel (OGV) exhaust gas capture system comprising:

a plurality of parallel-flow flexible ducts connectable to individual corresponding OGV exhaust pipes residing in an OGV stack to capture exhaust flows from the OGV exhaust pipes;

a plurality of horizontally facing connectors on free ends of the parallel-flow flexible ducts moveable horizontally over generally horizontally facing exhaust pipe mouths and configured for connecting and intimately sealing the parallel-flow flexible ducts to the OGV exhaust pipes;

a manifold connected to fixed ends opposite the free ends of the plurality of parallel-flow flexible ducts and receiving all of the exhaust flows captured by the plurality of parallel-flow flexible ducts from the OGV exhaust pipes;

a main duct connected to the manifold receiving all of the exhaust flows from the OGV exhaust pipes;

an emissions treatment system connected to the main duct and receiving all of the exhaust flows from the OGV exhaust pipes for processing the exhaust flows to reduce pollution in the exhaust flows;

sensors for determining positions of the plurality of parallel-flow flexible ducts and the OGV exhaust pipes; and a robotic arm apparatus for positioning and connecting the OGV exhaust gas capture system.

* * * * *